US008006821B2

(12) United States Patent
Seki et al.

(10) Patent No.: US 8,006,821 B2
(45) Date of Patent: Aug. 30, 2011

(54) ROTARY ANTI-PULLBACK UNIT OF FLETCHED FINS

(75) Inventors: Toru Seki, Osaka (JP); Shinya Izawa, Osaka (JP)

(73) Assignee: Japan Cash Machine Co., Ltd., Osaka (JP)

( * ) Notice: Subject to any disclaimer, the term of this patent is extended or adjusted under 35 U.S.C. 154(b) by 0 days.

(21) Appl. No.: 12/561,269

(22) Filed: Sep. 17, 2009

(65) Prior Publication Data

US 2011/0061987 A1 Mar. 17, 2011

(51) Int. Cl.
*G07D 7/00* (2006.01)

(52) U.S. Cl. ..... 194/203; 194/202; 194/206; 194/347; 194/349

(58) Field of Classification Search ..... 194/202, 194/203, 206, 207, 347, 349; 209/534
See application file for complete search history.

(56) References Cited

U.S. PATENT DOCUMENTS

| | | | | |
|---|---|---|---|---|
| 6,932,208 | B1 * | 8/2005 | Wen | 194/203 |
| 7,380,784 | B2 | 6/2008 | Mizuno | |
| 7,556,262 | B2 | 7/2009 | Mizuno | |
| 2006/0284410 | A1 | 12/2006 | Ito | |

FOREIGN PATENT DOCUMENTS

| | | |
|---|---|---|
| JP | 8-279065 | 10/1996 |
| JP | 8279065 | 10/1996 |
| JP | 2004070647 | 3/2004 |
| JP | J P2004-70647 | 3/2004 |
| JP | 2005-247497 | 9/2005 |
| JP | 2006-195595 | 7/2006 |
| JP | 2006195595 | 7/2006 |
| JP | 2006-338593 | 12/2006 |

OTHER PUBLICATIONS

WIPO PCT International Search Report for PCT/JP2009/004641.
WIPO PCT Written Opinion of the International Searching Authority.

* cited by examiner

*Primary Examiner* — Jeffrey A Shapiro
(74) *Attorney, Agent, or Firm* — James Michael Faier; Martin Faler; Faier & Faier P.C.

(57) ABSTRACT

A rotary anti-pullback unit is provided which comprises a rotor 22 and a frame 43 for rotatably supporting the rotor 22. Rotor 22 comprises a plurality of disks 25 arranged coaxially in a line and in axially spaced relation to each other, and a plurality of fletched fins 26 axially protruding from at least one radial surface 25*a* of disks 25 toward an opposite radial surface 25*a* of the other adjoining spaced disk 25. Rotor 22 is rotated concurrently with a bill 70 transported along each outer periphery of disks 25 in contact to transported bill 70 to radially inwardly move a flexible extracting tool 71 connected to bill 70, and bring tool 71 into tangled engagement with fin or fins 26 in order to prevent unduly extraction of bill 70.

27 Claims, 21 Drawing Sheets

ROTARY ANTI-PULLBACK UNIT OF FLETCHED FINS

TECHNICAL FIELD

This invention relates to a rotary anti-pullback unit of fletched fins for preventing unauthorized extraction of a valuable document from inside of a document handling machine by pulling a string connected to the document.

BACKGROUND OF THE INVENTION

There have been developed many bill handling machines such as vending machines, exchangers, automatic cash dispensers, automatic teller machines and bill validators mounted in gaming machines. Sometimes, these bill handling machines may encounter an illegal action by an imprudent person who fraudulently tries to extract a bill from inside of the machine by pulling out a string connected to the bill already received within the machine as a genuine one. To inhibit such a fraudulent action, some of these machines have an anti-pullback unit for preventing the bill from being taken out of the machine with any extracting tool.

U.S. 2006/284410A1 discloses a bill processing device which comprises a plurality of long channels disposed on a convexly bent path surface to form a bill path along a conveying direction of a bill and in parallel relation to each other in a transverse direction of the bill path, and a row of projections extending from respective side walls of the long channels. Each projection has a first surface inclined to a bottom surface side of the long channel to guide a foreign matter such as string or band conveyed with the bill to enter the long channel, and a second surface horizontal or inclined to the bottom surface side of the channel to inhibit string which has entered the long channel from exiting from the long channel. When string is connected to conveyed bill, it naturally enters long channel away from side wall to radially inward move along the first surface of the projection. Then, the string further goes into a recessed hole adjacent to the projection to effectively hinder escape of string from the recessed hole.

However, the disclosed bill processing device has a drawback in that disadvantageously it only has a single row of the stationary and irrotational projections not to wind or tangle string or band connected to the conveyed bill around projection and a bottom surface of the long channel. Accordingly, the prior art bill processing device would involve a large risk of inconvenient extraction of bill by drawing the string connected to bill.

Therefore, an object of the present invention is to provide a rotary anti-pullback unit of fletched fins for preventing extraction of a valuable document already received or stacked within an associated device by pulling out an extracting tool connected to the document. Another object of the present invention is to provide a rotary anti-pullback unit of fletched fins provided with a rotatable rotor capable of reeling an extracting tool connected to a document around the rotor to inhibit fraudulent extraction of the document.

SUMMARY OF THE INVENTION

The rotary anti-pullback unit of fletched fins according to the present invention, comprises a rotor (22) and a frame (43) for rotatably supporting rotor (22). Rotor (22) comprises a plurality of disks (25) arranged coaxially in a line and in axially spaced relation to each other, and a plurality of fletched fins (26) axially protruding from at least one radial surface (25*a*) of disks (25) toward an opposite radial surface (25*a*) of the other adjoining spaced disk (25). Each fin (26) comprises a radially outwardly tapered guide surface (26*a*) formed at the radially outer edge of fin (26) and a barb (Mb) formed at the radially inner edge of fin (26). Rotor (22) is rotated concurrently with a document (70) transported along each outer periphery of disks (25) in contact to transported document (70) to radially inwardly move a flexible extracting tool (71) connected to document (70) along tapered guide surface (26*a*) of fin (26), and bring it into engagement with barb (Mb) of fin (26) so that extracting tool (71) is tangled around rotor (22) and fin or fins (26) to prevent unduly extraction of document (70).

BRIEF DESCRIPTION OF THE DRAWINGS

The above-mentioned and other objects and advantages of the rotary anti-pullback unit of fletched fins according to the present invention will be apparent from the following description in connection with preferred embodiments shown in the accompanying drawings wherein.

BEST MODE FOR CARRYING OUT THE INVENTION

Embodiments will be described hereinafter in connection with FIGS. 1 to 29 of the drawings regarding the rotary anti-pullback unit of fletched fins according to the present invention applied to a document handler, namely bill validator.

Figure 6:
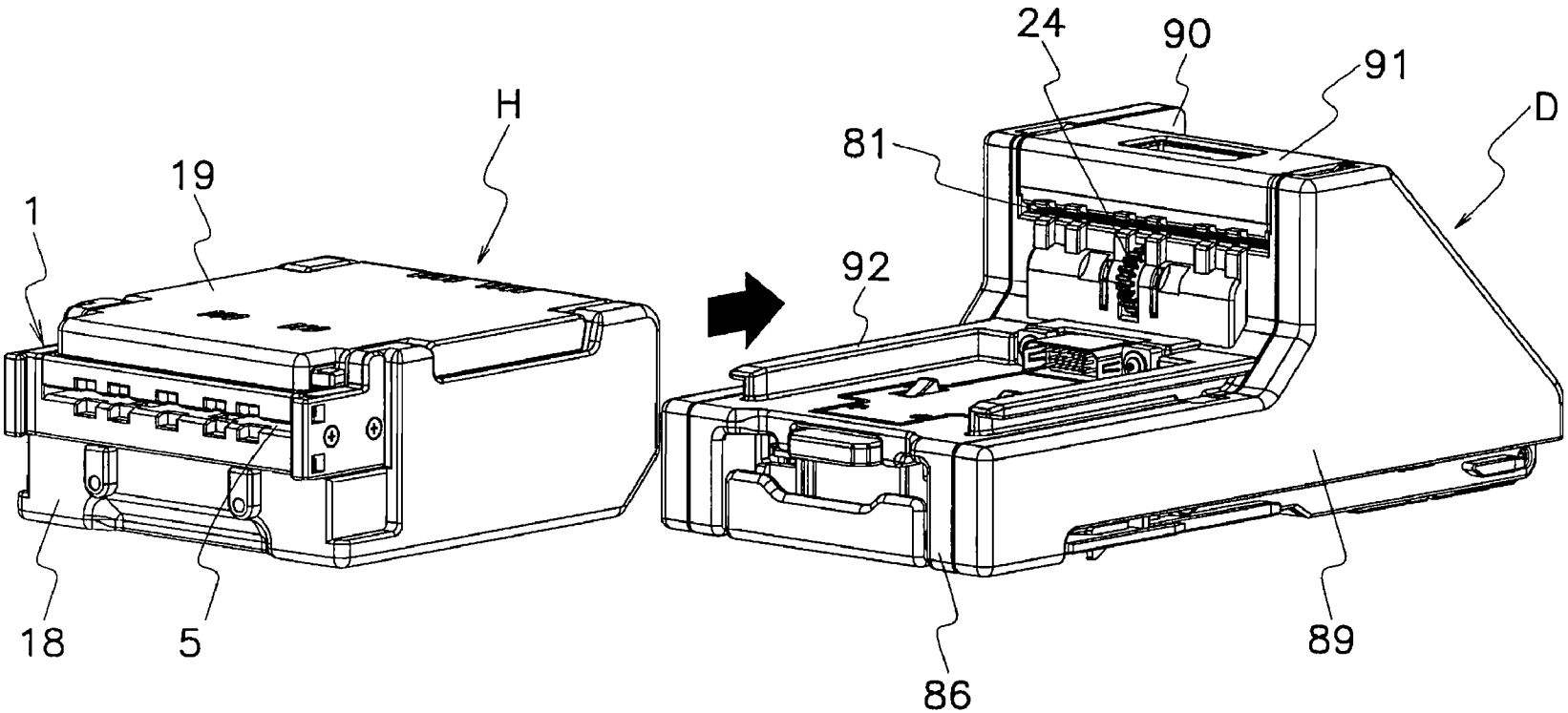
FIG. 6 is a perspective view of the bill validator that has a discriminator and a conveyer before the discriminator is drivingly connected to the conveyer.
Figure 7:
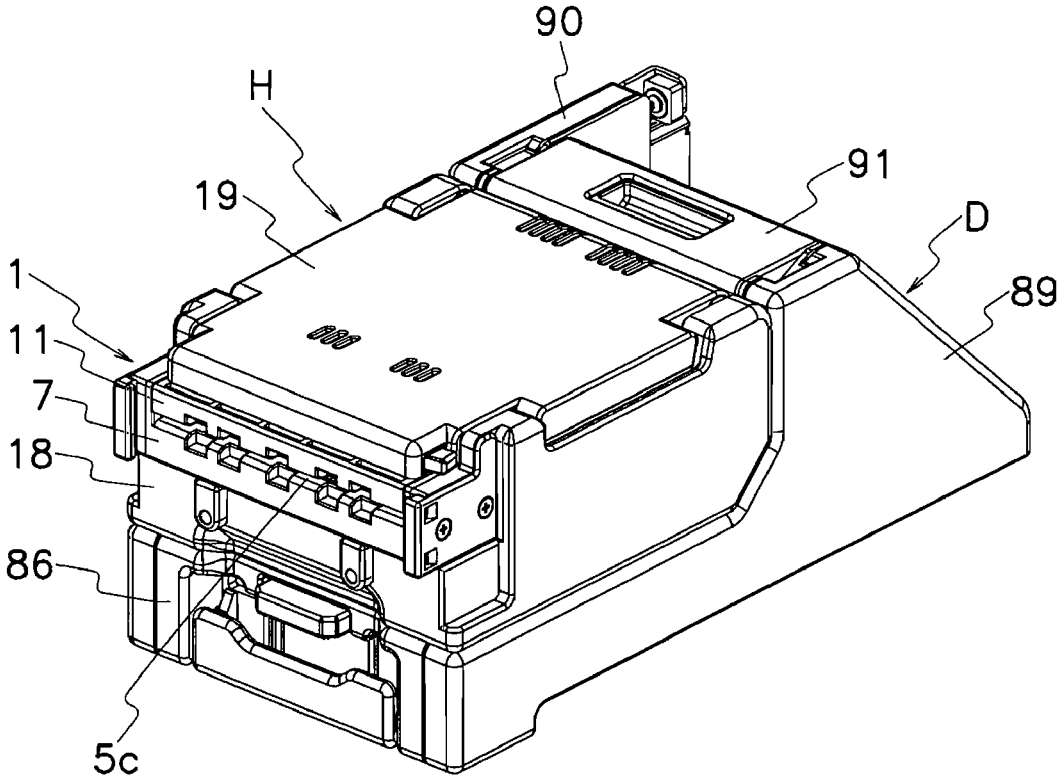
FIG. 7 is a perspective view of the bill validator after the discriminator is drivingly connected to the conveyer.

FIGS. 6 and 7 shows a bill validator that comprises a conveyer D provided with a rotary anti-pullback unit of fletched fins according to the present invention, and a discriminator H detachably mounted on conveyer D.

As shown in FIGS. 8 to 14, conveyer D comprises a rotary anti-pullback unit 21 of fletched fins according to the instant invention. As is more clearly illustrated in FIGS. 11 to 14, the rotary anti-pullback unit 21 comprises a frame 43, a fletched rotor 22 rotatably mounted on frame 43, and a rotor driver 23 for rotating rotor 22 when a document or bill 70 is transported along each outer periphery of disks 25. As will be understood from FIG. 16, rotor 22 comprises a plurality of rollers 24 rotatably, coaxially in a line supported on frame 43, and rotor pulleys 36, 37 rotatably and coaxially mounted with rotor 22 for their integral rotation to form a part of rotor driver 23. As shown in FIGS. 16 to 21, each roller 24 comprises a column 29 formed at the center of rotor 22 and rotatably supported by frame 43 at the opposite ends, a plurality of disks 25 secured on column 29 coaxially in a line and in axially spaced relation to each other to radially outwardly extend from column 29, and a plurality of featherings, fletchings or fins 26 protruding axially from and perpendicularly to at least one radial surface 25*a* of disks 25 toward an opposite radial surface 25*a* of the other adjoining spaced disk 25.

Figure 20:
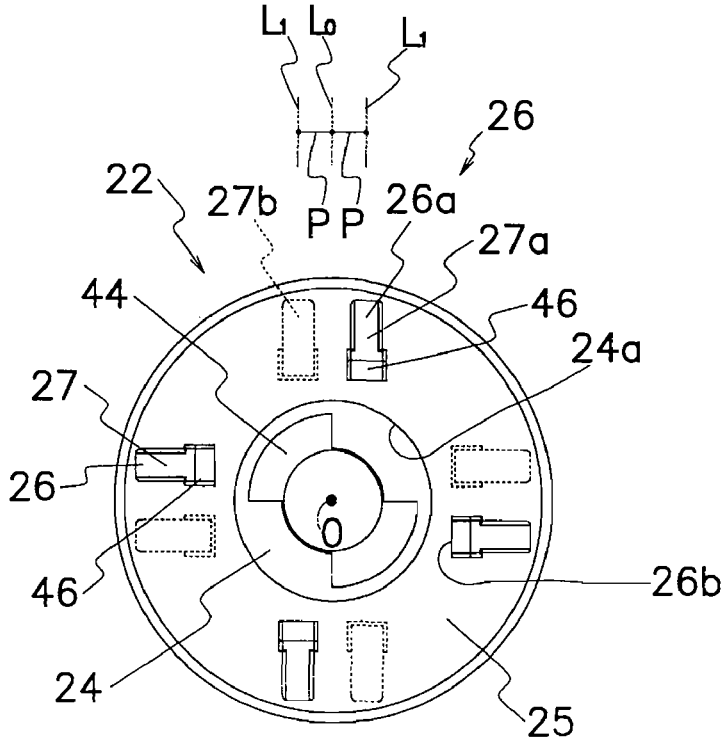
FIG. 20 is an end view of the roller.

In other words, one radial surface 25*a* of one disk 25 has fins 26 axially protruding toward an opposed radial surface 25*a* of the other spaced adjoining disk 25 whose opposed radial surface 25*a* has fins 26 protruding axially in the opposite direction from that of former fins 26 toward the one radial surface 25*a* of the one disk 25. As shown in FIG. 20, the closest two fins 26 in one and the other radial surfaces 25*a* are grouped into a pair with a circumferential gap 47 between paired fins 26. In the shown embodiment, each radial surface 25*a* of disks 25 has four axial fins 26 formed on radial surface 25*a* at regularly angular intervals of 90 degrees, and each disk 25 has its opposite radial surfaces 25*a* formed with fins 26 axially protruding therefrom. However, each radial surface 25*a* of disks 25 may have two or more fins 26 formed on the radial surface 25*a* at regularly or irregularly angular intervals as necessary. Rollers 24 are integrally formed of a plastic material selected from the groups of ABS, polyamide, polyacetal, polycarbonate resins or mixed compound thereof. Rotor 22 shown in FIG. 16 comprises three rollers 24 and two rotor pulleys 36, 37 located between adjoining rollers 24, however, one of ordinary skill in the art would be able to decide number and shape of rollers 24 and rotor pulleys 36, 37 as necessary.

Figure 16:
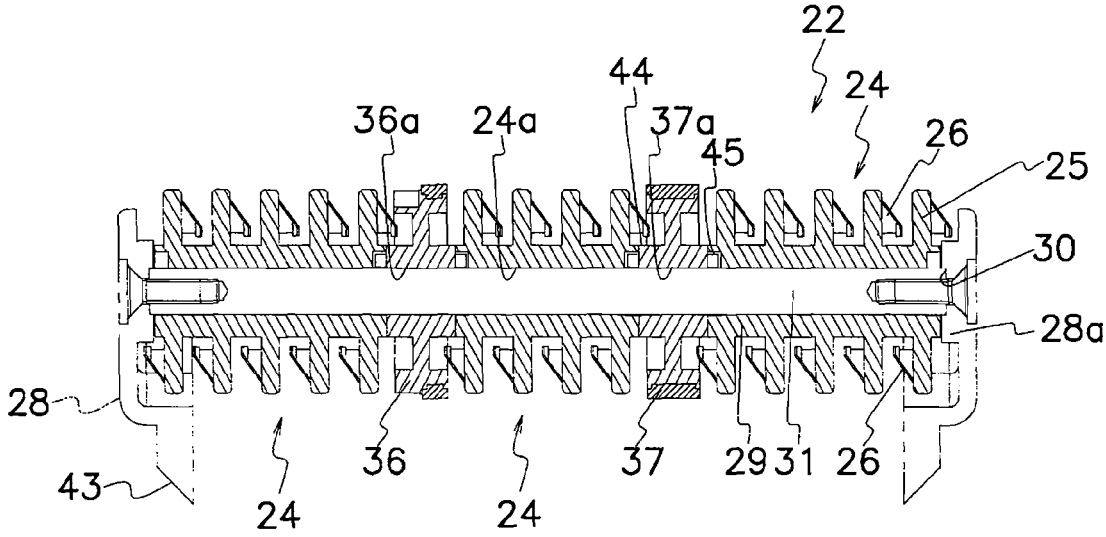
FIG. 16 is a sectional view of a roller in the rotary anti-pullback unit.
Figure 22:
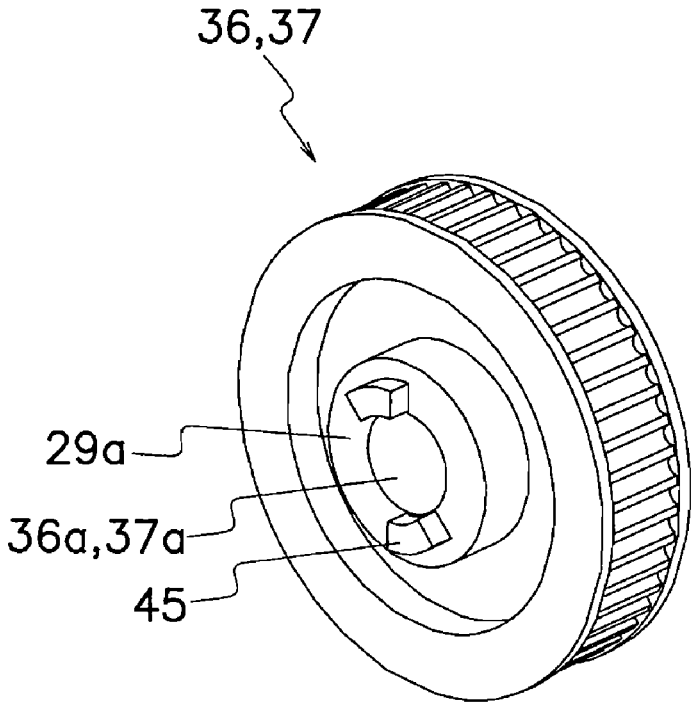
FIG. 22 is a perspective view of a rotor pulley.

As shown in FIGS. 17 to 20, sector grooves 44 are formed at opposite ends of column 29 in each roller 24, and as shown in FIGS. 16 and 22, formed at opposite ends of bosses 29*a* in rotor pulleys 36, 37 are sector projections 45 that have a complementary shape to that of sector grooves 44 in column 29 so that sector projections 45 can be fit in corresponding sector grooves 44 to form a rotatable integrated structure of adjacent rotor pulleys 36, 37 and rollers 24 by their set-in coupling structure. In other words, at least one paired sector groove 44 and sector projection 45 may be formed in one and the other of column 29 of rollers 24 and rotor pulleys 36, 37, and sector projections 45 may be fit in sector grooves 44 to establish a set-in coupling structure that effectively and firmly joins adjacent rollers 24 and rotor pulleys 36, 37 for their mechanical axial connection and for their integral rotation. Other sectional shapes than sector such as circular, oval or rectangular section may be used for combined projections and grooves. In further ways, disks 25 and column 29 may be integrally formed in mold into a single roller 24 or may be connected each other by welding, bonding or adhering. Each disk 25 has its configuration formed in a mirror image with respect to the central axis of disks 25.

Figure 12:
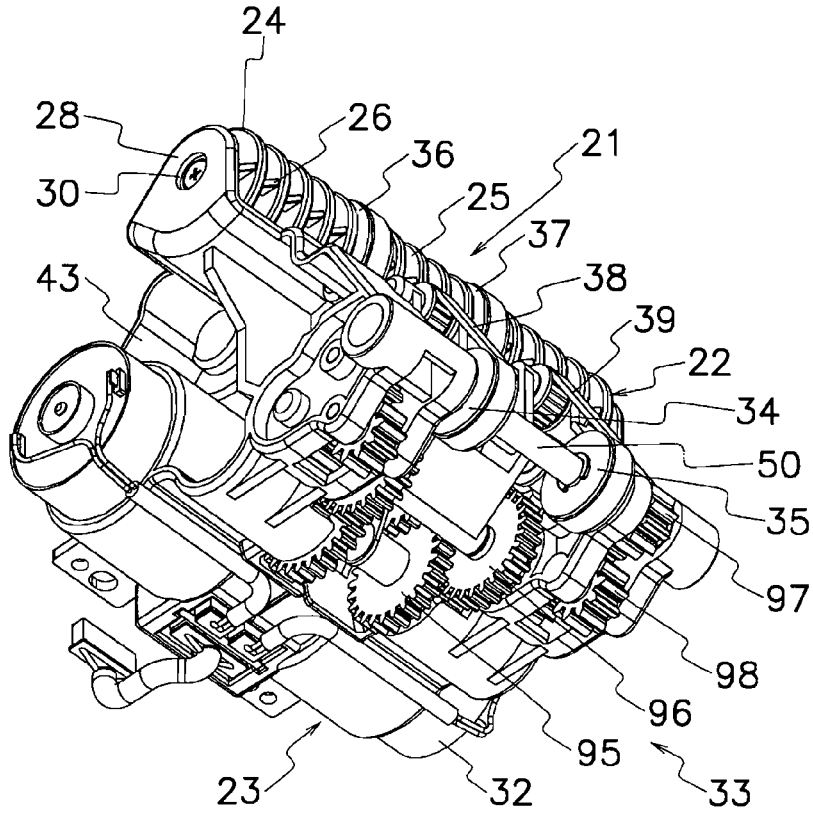
FIG. 12 is a back bottom perspective view of the rotary anti-pullback unit.
Figure 13:
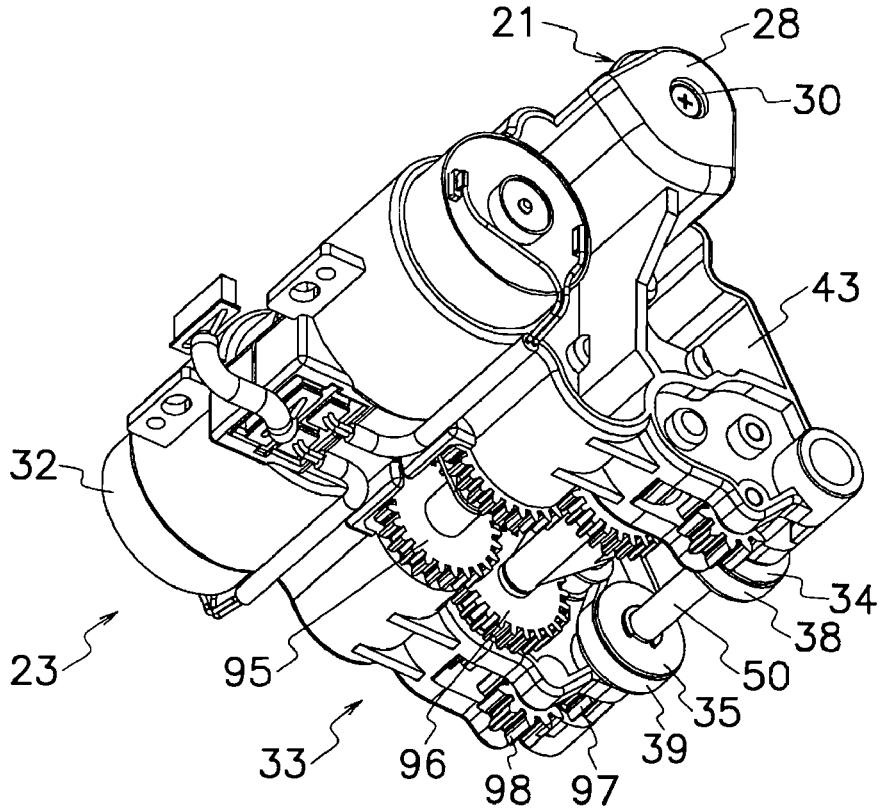
FIG. 13 is a front bottom perspective view of the rotary anti-pullback unit.
Figure 14:
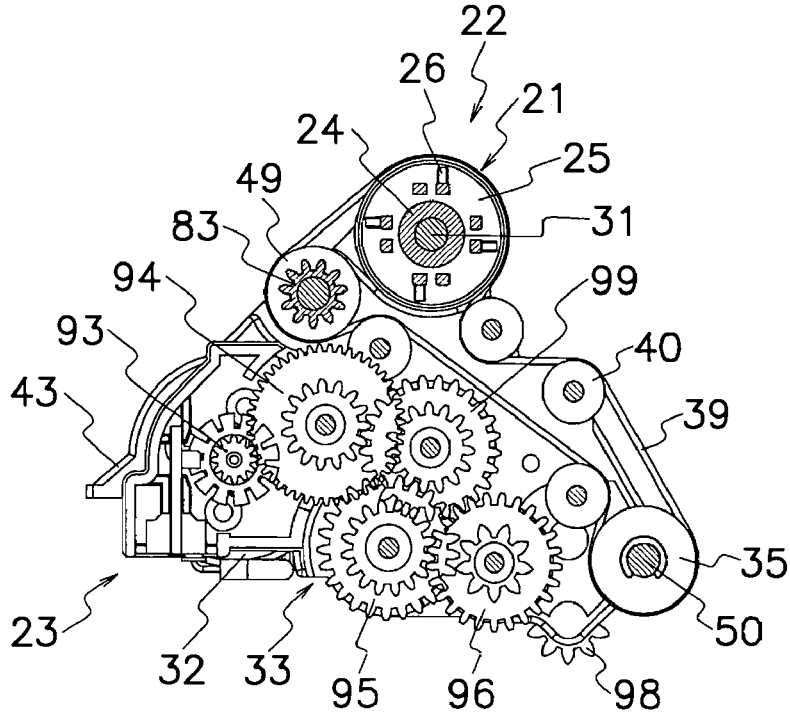
FIG. 14 is a sectional view taken along a line XIV-XIV in FIG. 11.
Figure 15:
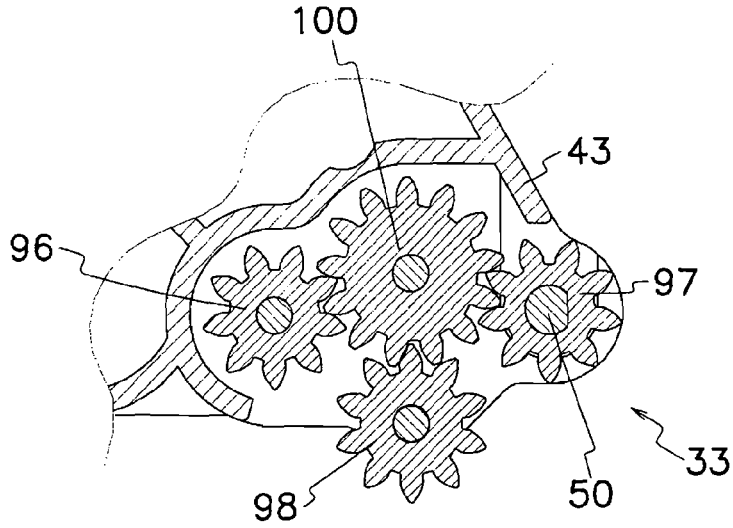
FIG. 15 is a sectional view taken along a line XV-XV in FIG. 11.

As will be apparent from FIGS. 12 and 13, frame 43 has a bracket 28 for rotatably supporting rotor 22. To this end, FIG. 16 indicates the bracket 28 formed with a pair of bosses 28*a* located opposite and in direct contact to both axial ends of column 29 of rollers 24 for smooth relative rotation of rollers 24 on stationary bosses 28*a*. If rotor pulleys 36, 37 are located at axial ends of rotor 22, boss 29*a* of rotor pulleys 36, 37 may be in direct contact to boss 28*a* of bracket 28 without projections 45. Bracket 28 may be formed of a plastic material such as ABS, polyamide, polyacetal, polycarbonate resin or mixed compound thereof or a metallic material.

As is obvious from FIGS. 12 to 15, rotor driver 23 comprises a drive motor 32 retained in frame 43, a gear train 33 that includes a pinion 93 of drive motor 32 and power transmission gears 94 to 100 driven by drive motor 32 all in frame 43, drive pulleys 34, 35 driven by gear train 33, rotor pulleys 36, 37 coaxially mounted on rotor 22, drive belts 38, 39 mutually wound around rotor pulleys 36, 37 and around drive pulleys 34, 35 in anti-pullback unit 21, and a plurality of idle rollers 40 for retaining drive belts 38, 39 in position. Rotor pulleys 36, 37 are rotated integrally with rotor 22 by operation of drive motor 32 when bill 70 is transported along each outer periphery of disks 25 in contact to transported bill 70. When bill 70 has passed anti-pullback unit 21, drive belts 38, 39 serve to further transport bill 70 toward an outlet 82 of an inclined path 63. Frame 43 supports rotor driver 23 and anti-pullback unit 21 as a unit.

In the embodiment shown in FIG. 16, rotor 22 comprises a support shaft 31 whose both ends are received within corresponding recesses 30 formed at the center of bosses 28*a* in bracket 28. A perforation or bore 24*a* is formed in column 29 of rollers 24, and holes 36*a*, 37*a* are formed on boss 29*a* of rotor pulleys 36, 37 shown in FIG. 22 to dispose support shaft 31 in bore 24*a* and holes 36*a*, 37*a* so that support rotor 22 is rotatably mounted on support shaft 31. If column 29 of rollers 24 and boss 29*a* of rotor pulleys 36, 37 are joined into an integral structure via any known mechanical, welding or bonding means, columns 29 of rollers 24 and bosses 29*a* of rotor pulleys 36, 37 all in one unit may provide an alternative shaft to rotatably support rollers 24 on bracket 28 with omission of support shaft 31.

Figure 21:
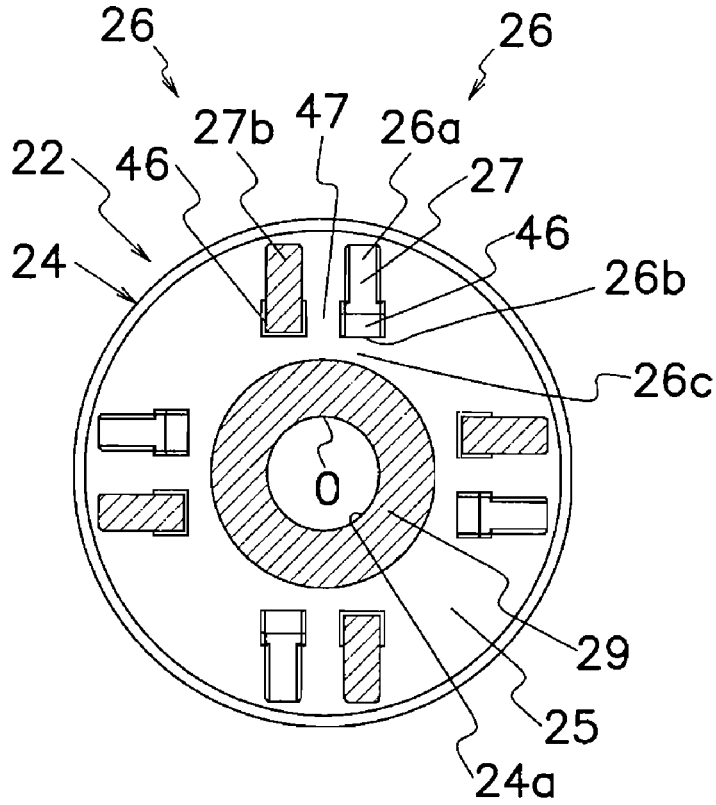
FIG. 21 is a sectional view of the roller.

As clearly illustrated in FIGS. 17 to 21, each fin 26 has a radially outwardly tapered guide surface 26*a* formed at the radially outer edge of fin 26, a radially inward barb 26*b* formed at the radially inner edge of fin 26, and a hook 46 formed at the tip of fin 26 between guide surface 26*a* and barb 26*b* so that each fin 26 is generally formed into a substantially feathering or triangular shape. Tapered guide surface 26*a* may be formed into a flat, curved or combined flat and curved surface on the lean. Barb 26*b* may be formed into a flat, curved or combined flat and curved surface, or may be formed in parallel to or at a slant to the central axis of rollers 24. A pair of fins 26 are shown in FIGS. 20 and 21 by reference numeral 27 for illustrative convenience, so four fins 27*a* are formed on each radial surface 25*a* of disks 25 at angular intervals of 90 degrees along an axial line $L_1$ away from a diametrical central line $L_0$ in the clockwise direction by a certain distance P, and axial line $L_1$ and diametrical central line $L_0$ are parallel to each other.

In contrast, opposed radial surface 25*a* of spaced adjoining disks 25 is formed with four fins 27*b* shown in phantom at angular intervals of 90 degrees along axial line $L_1$ away from diametrical central line $L_0$ in the counterclockwise direction by distance P. Four fins 27*a* and four fins 27*b*, namely fins 26 are formed symmetrically or in mirror image each other relative to diametrical central line $L_0$ to alternately project in the adverse direction from each other in pairs. Thus, each fin 26 is formed at a location away from diametrical central line $L_0$ passing through a rotation axis O of disk 25 by distance P, and each guide surface 26*a* of fins 26 spreads into a feathering or triangular shape in parallel to a longitudinal central plane including the diametrical central line $L_0$.

Figure 17:
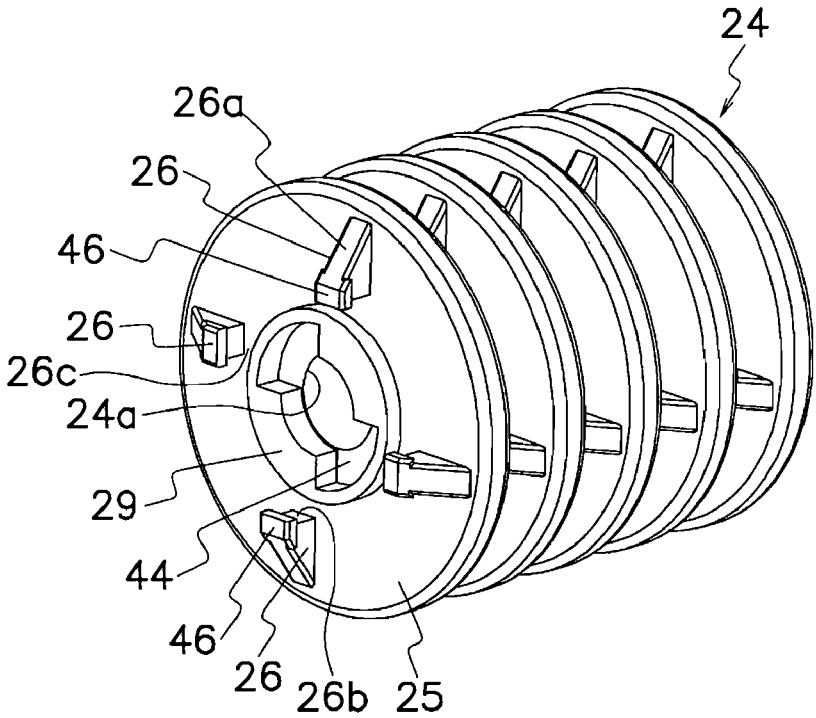
FIG. 17 is an end perspective view of a roller used in the rotor.
Figure 18:
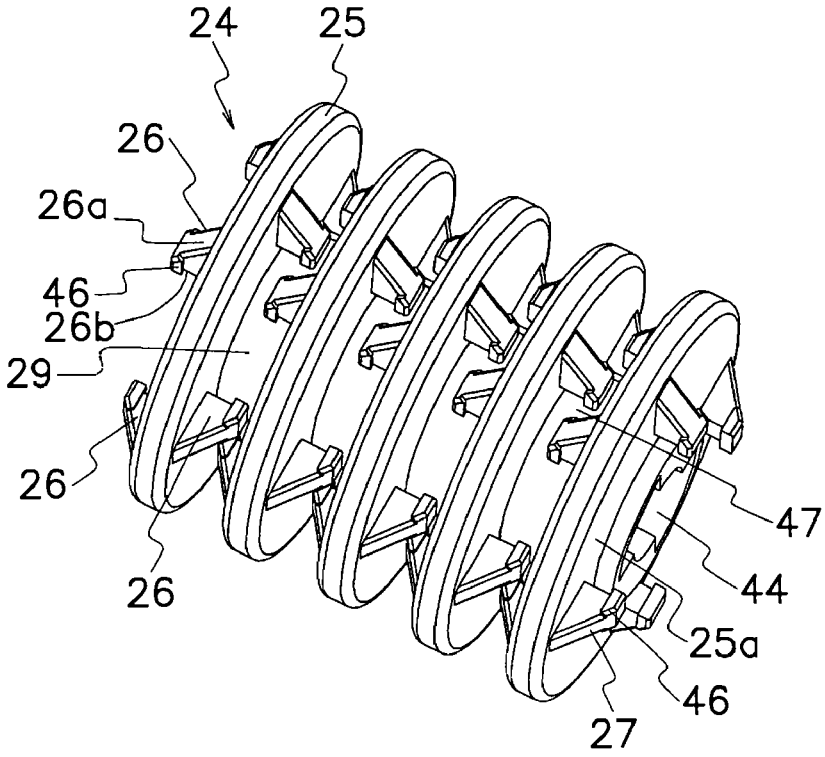
FIG. 18 is a top perspective view of the roller.
Figure 19:
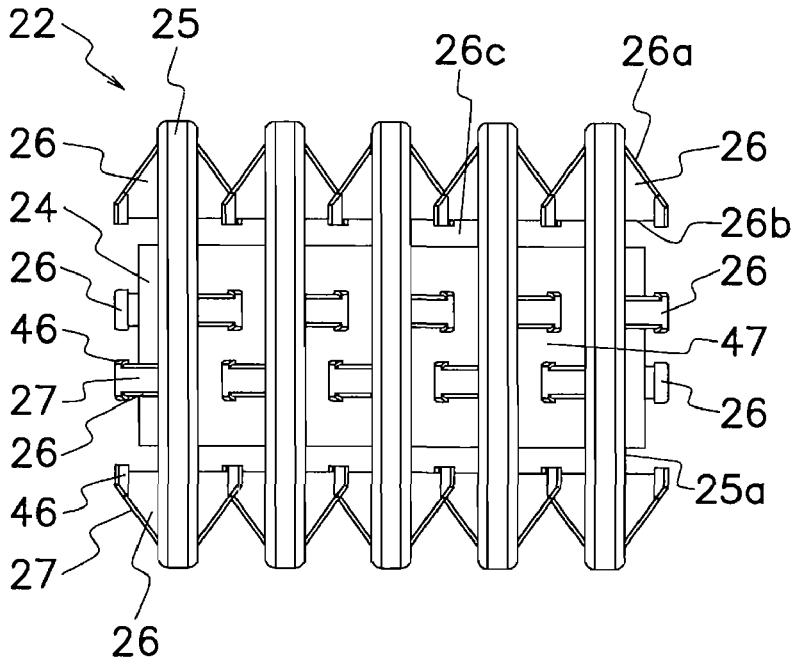
FIG. 19 is a top view of the roller.

As shown in FIGS. 17 and 18, hook 46 at each tip of fins 26 has a flange 46*a* which protrudes widthwise and inwardly or in the circumferential and radially inward directions of fin 26 to prevent an extracting tool 71 such as a string, cord or tape from escaping from a capture space 26*c* between barb 26*b* and column 29, thereby blocking fraudulent extraction of bill 70. As shown in FIG. 17, each fin 26 axially protrudes from and substantially perpendicularly to radial surface 25*a* of disk 25 toward an opposed radial surface 25*a* of spaced adjoining disk 25, and guide surface 26*a* is formed at an acute angle with disk 25 so that hook 46 is closer to opposed radial surface 25*a* of spaced adjoining disk 25 than that axially protruding from the latter opposed radial surface 25*a*. Accordingly, opposed fins 26 extend in the adverse direction from corresponding radial surfaces 25*a* of spaced adjoining disks 25 with a circumferential gap 47 (FIGS. 19 and 23) and have an axial overlap by at least one portion of fins 26, namely the whole or part of hook 46, and part of guide surface 26*a*, if necessary.

Figure 1:
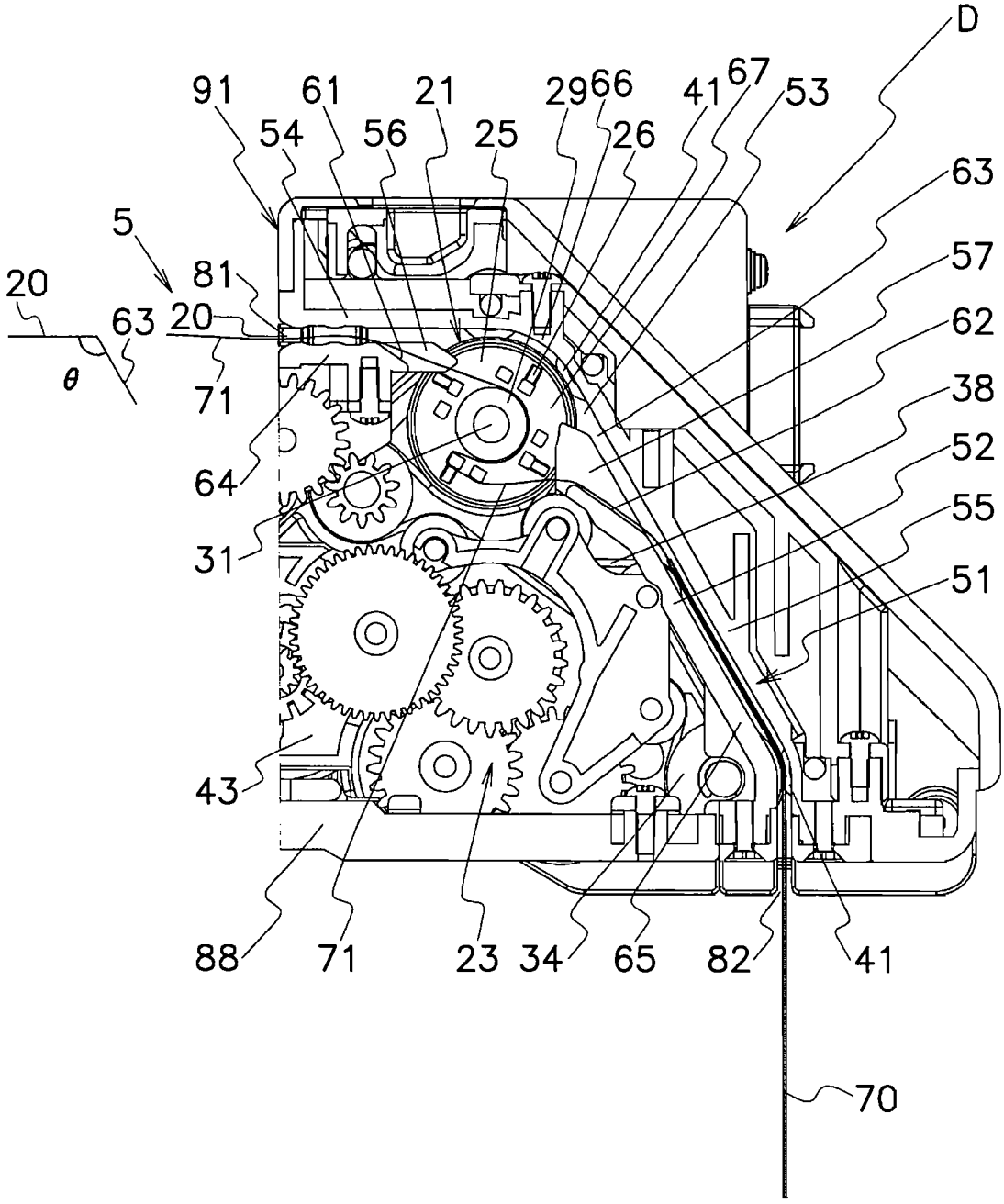
FIG. 1 is a fragmentary sectional view showing an embodiment of the rotary anti-pullback unit according to the present invention applied to a bill validator.
Figure 2:
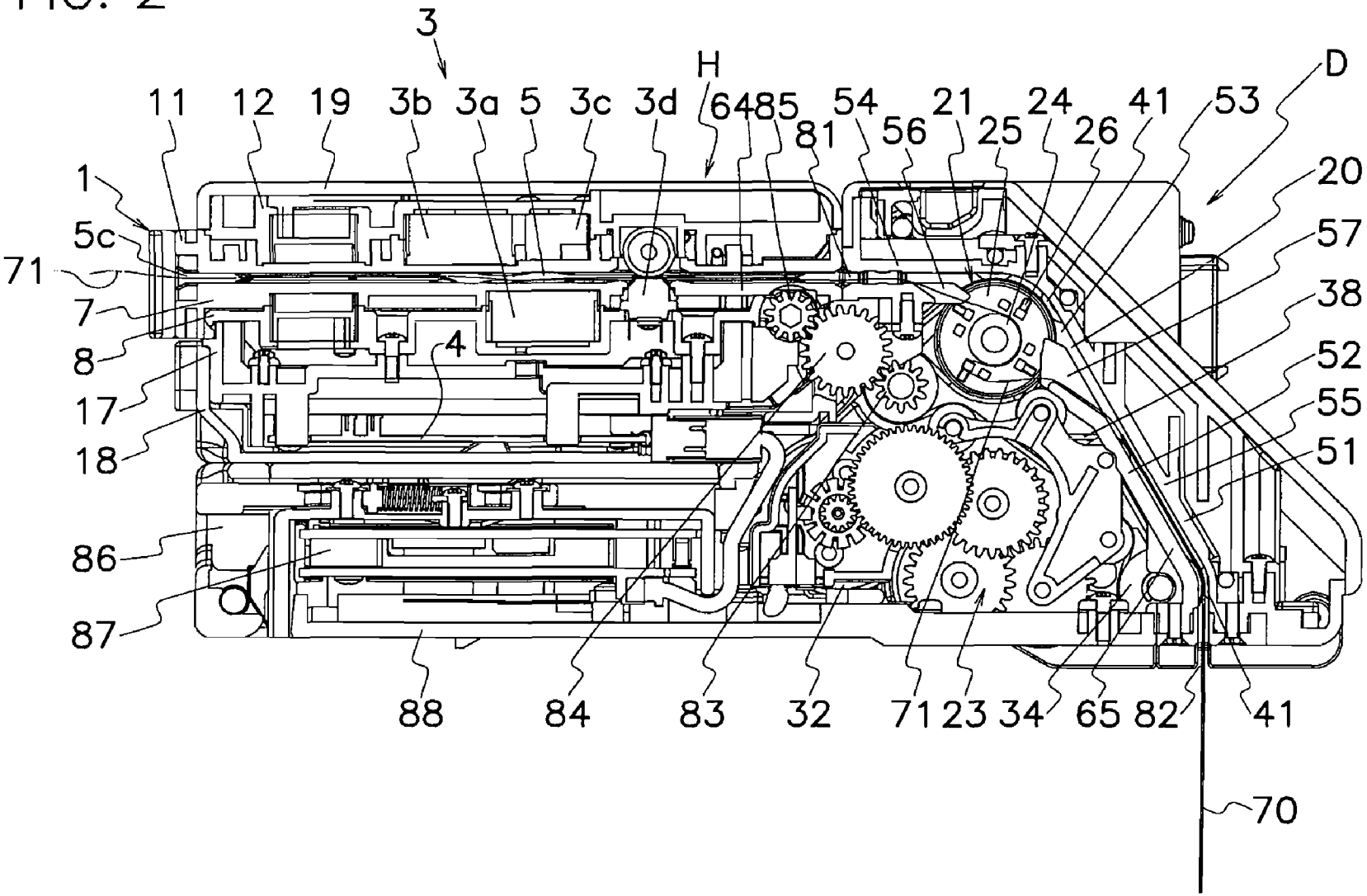
FIG. 2 is an entire sectional view of the bill validator shown in FIG. 1.
Figure 9:
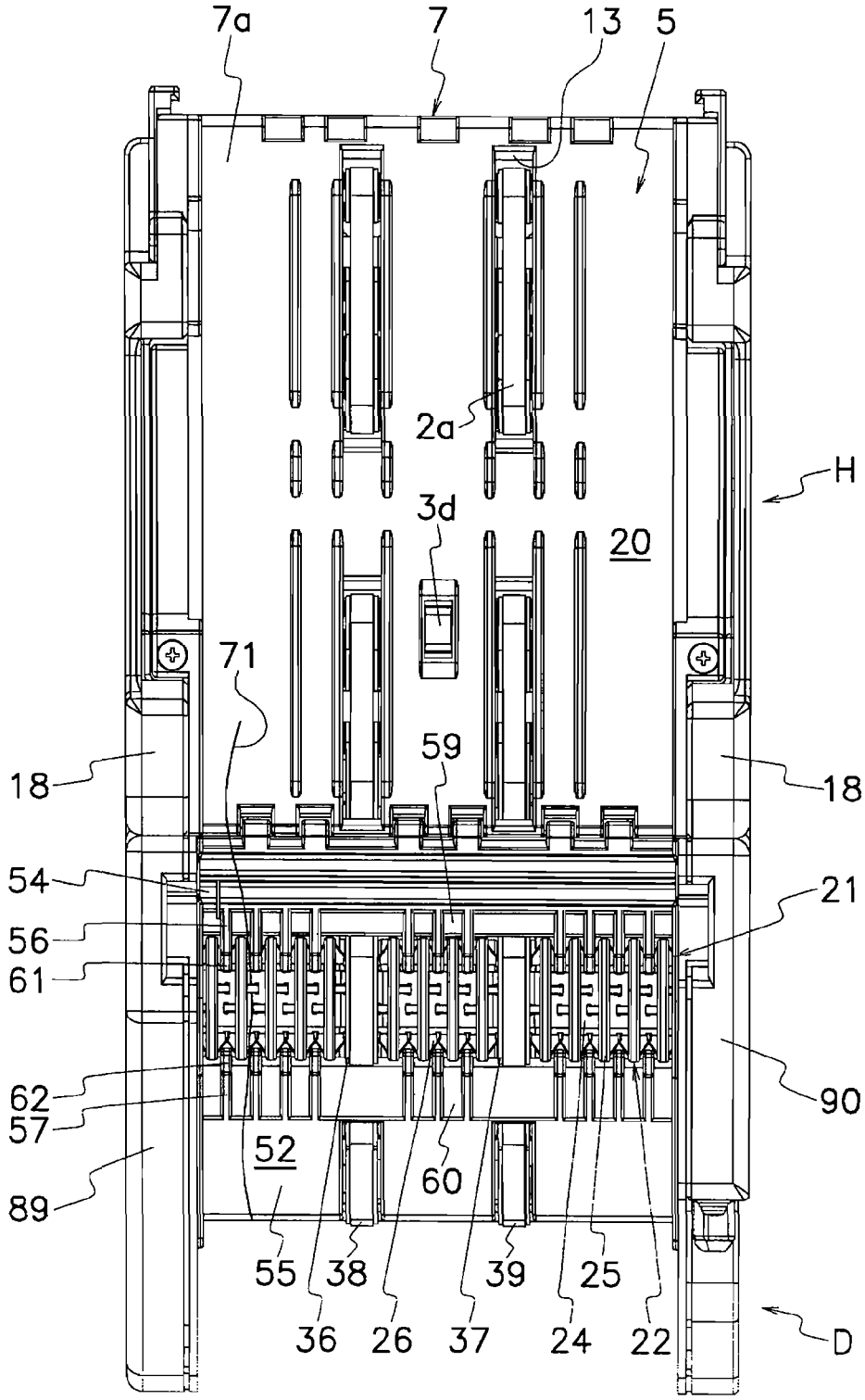
FIG. 9 is a plan view of the conveyer with removal of an upper casing.

As shown in FIGS. 1 to 6, conveyer D has a horizontal path 20, an arcuate passage 53 communicated with horizontal path 20, and an inclined path 63 connecting arcuate passage 53 to an outlet 82 to form a passageway 5 in all for guiding transported bill 70. Also, as shown in FIGS. 1 and 2, conveyer D has upper and lower guide members 51, 52 for providing respectively upper and lower walls of passageway 5. Upper guide member 51 comprises an upper plate member 54, an upper inclined member 55 slanting with respect to upper plate member 54 by a given angle and an arcuate member 66 disposed between upper plate and inclined members 54, 55. As shown in FIGS. 1 and 9, lower guide member 52 comprises a lower plate member 64 and a lower inclined member 65 slanting with respect to lower plate member 64 by a given angle to define an arcuate gap 67 between lower plate and inclined members 64, 65 so that rotor 22 is placed in arcuate gap 67. Arcuate passage 53 is formed by arcuate member 66 and rotor 22.

Figure 8:
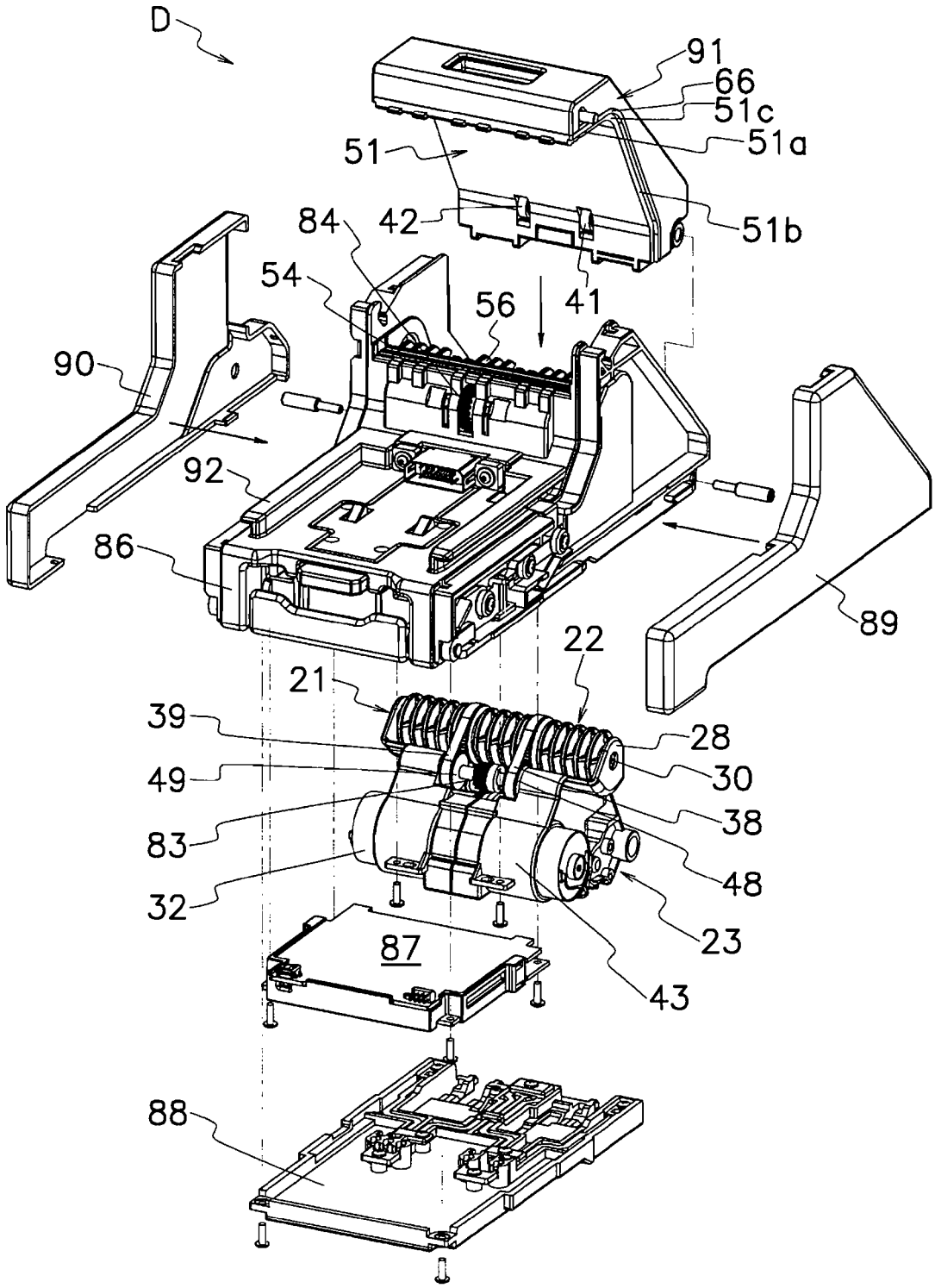
FIG. 8 is an exploded perspective view of the conveyer.

Arcuate passage 53 is curved around support shaft 31 of roller 24 in an approximate angular range of 90 degrees so that each outer periphery of disks 25 is disposed in and along arcuate passage 53. Upper and lower plate members 54, 64 make up together horizontal path 20 extending from an inlet 81 of conveyer D to arcuate passage 53, and upper and lower inclined members 55, 65 make up together an inclined path 63 extending from arcuate passage 53 to an outlet 82 of conveyer D. Arcuate passage 53 is curved at an approximate angle θ=120 degrees from horizontal path 20 to inclined path 63 around central axis 31, however, the curved angle θ may be varied in an angular range between 60 and 360 degrees. As shown in FIGS. 1, 2 and 8, provided in upper guide member 51 are pinch rollers 41, 42 for urging transported bill 70 on drive belts 38, 39 to sandwich bill 70 between drive belts 38, 39 and pinch rollers 41, 42 for reliable transportation of bill 70. In the shown embodiment, anti-pullback unit 21 is mounted in lower guide member 52, but, instead, it may be mounted in upper guide member 51 or straddling upper and lower guide members 51 and 52.

Figure 10:
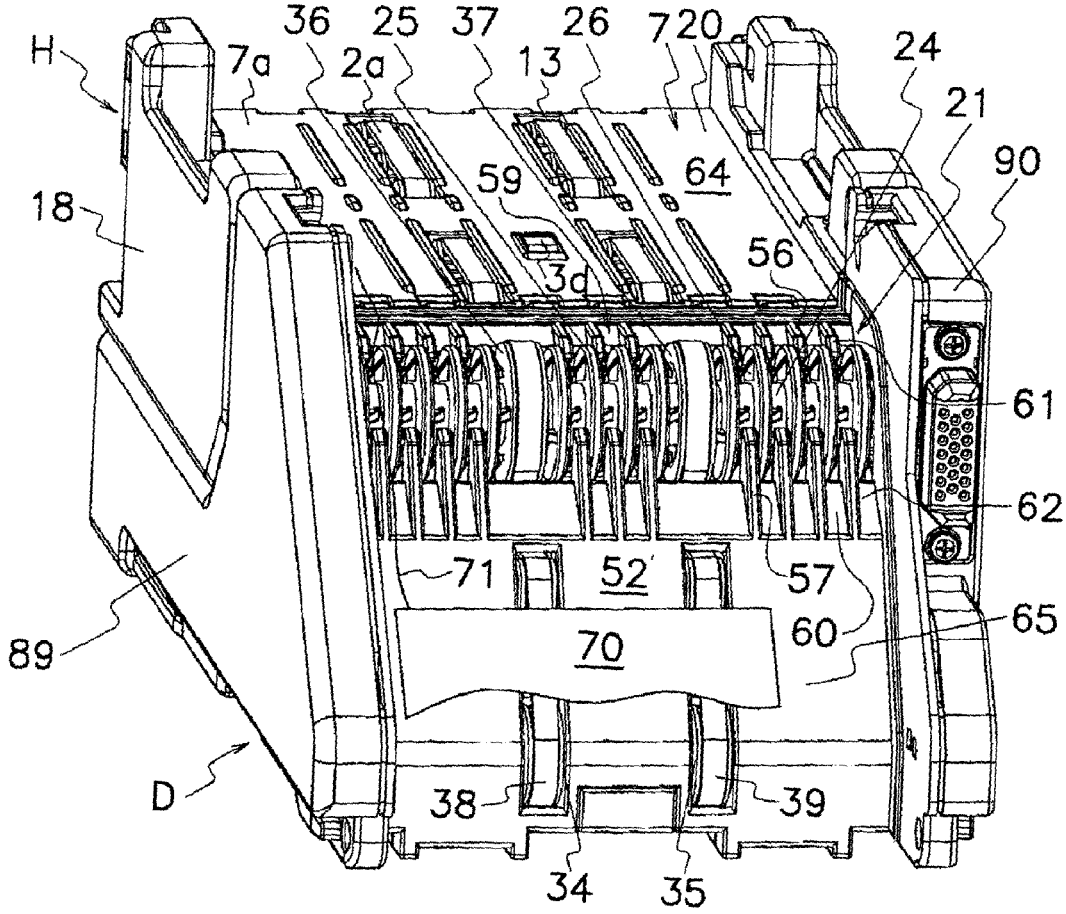
FIG. 10 is a perspective view of the conveyer shown in FIG. 9.
Figure 11:
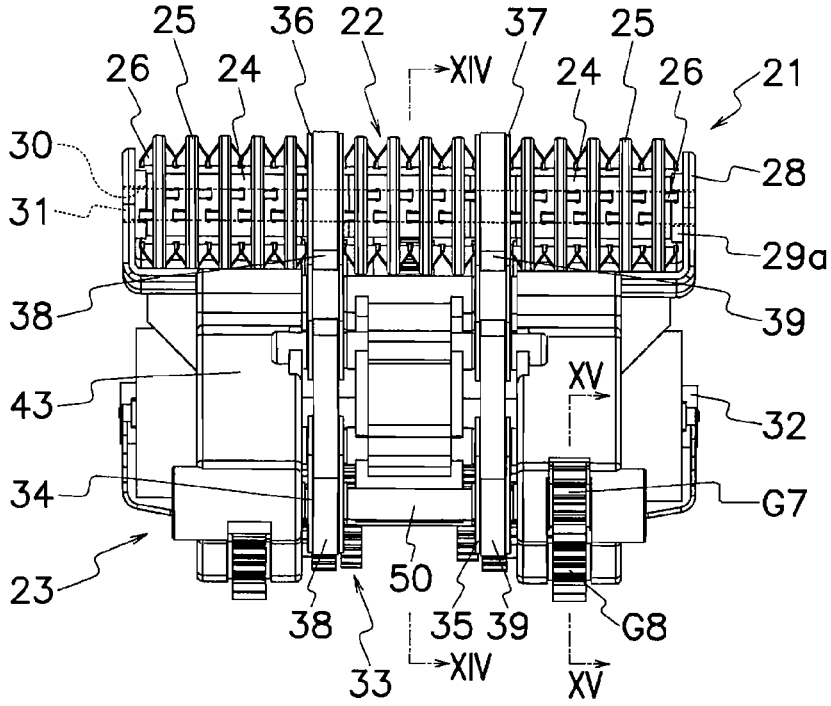
FIG. 11 is a back view of the rotary anti-pullback unit.

As illustrated in FIGS. 1, 2, 10, 23 and 24, formed with lower plate member 64 in lower guide member 52, are tongues 56 that downwardly extend from lower plate member 64 toward anti-pullback unit 21, and likewise, formed with lower inclined member 65 in lower guide member 52 are tongues 57 that upwardly extend from lower inclined member 65 toward anti-pullback unit 21. As shown in FIGS. 9 and 10, and especially FIG. 23, each tongue 56, 57 extends toward inclined guide surfaces 26*a* of fins 26 and terminates before inclined guide surfaces 26*a* with an oblique gap 58 between each tongue 56, 57 and inclined guide surface 26*a*. As shown in detail especially in FIGS. 23 and 24, tongues 56, 57 stretch from respectively lower plate and inclined members 64, 65 both toward guide surfaces 26*a* of opposed disks 25 in anti-pullback unit 21 so that tongues 56, 57 are in a spaced relation to closest guide surfaces 26*a* to form oblique gap 58 therebetween. Each tongue 56, 57 between adjoining cutouts 59, 60 has a cutoff surface 61, 62 flush with or along by a plane passing through the central axis of support shaft 31 for roller 24.

As shown in FIG. 2, conveyer D comprises a lower casing 86 for forming a bottom wall of horizontal path 20, an upper casing 91 (FIG. 8) disposed at the back of lower casing 86 for forming an upper wall of horizontal path 20, a connection gear 84 rotatably mounted on lower casing 86 and drivingly connected to a transport gear 85 in discrimination device H, a drive output gear 83 for transmitting rotation force to transport gear 85 via connection gear 84, a control device 87 for controlling operation of rotor driver 23, a bottom tray 88 attached at the bottom of lower casing 86, a pair of guide rails 92 formed on an upper surface of lower casing 86 for engagement with latches (not shown) in discriminator H and sliding movement of the latches along guide rails 92, and right and left casings 89 and 90 attached to respectively right and left sides of lower casing 86.

As shown in FIGS. 2 to 6, 9 and 10, discriminator H comprises a casing 1 disposed between an upper casing 19 and lower frame 17 secured on a lower casing 18 for defining passageway 5, conveyer belts 2*a* (FIGS. 9 and 10) for transporting bill 70 along horizontal path 20 of passageway 5, and a sensor device 3 having optical and magnetic sensors 3*a*, 3*b*, 3*c*, 3*d* for detecting physical features of bill 70 traveling along horizontal path 20 to produce detection signals. Control device 87 receives detection signals from sensor device 3 to control operation of conveyer belts 2*a* in discriminator H shown in FIGS. 9 and 10. Casing 1 comprises a lower casing 18 which has a lower cover 7 and a lower tray 8 for receiving a lower optical sensor 3*a* and other electric/electronic elements, and an upper casing 19 which has an upper tray 11 and an upper cover 12 for receiving an upper optical sensor 3*b* and other electric/electronic elements. Sensor device 3 comprises an upper optical sensor 3*a* contained in lower casing 18, an upper optical sensor 3*b* and a light receiving sensor 3*c* both contained in upper casing 19, an optical inlet sensor (not shown) for detecting insertion of bill 70 into passageway 5, and a magnetic sensor 3*d* for detecting iron content contained in ink printed on bill 70. Control device 87 receives detection signals from sensor device 3 to produce to conveyer D control signals which drive conveyer belts 2*a* and drive motor 32 and drive belts 38, 39 in anti-pullback unit 21 shown in FIGS. 13 and 14, depending on detection signals from sensor device 3.

Figure 3:
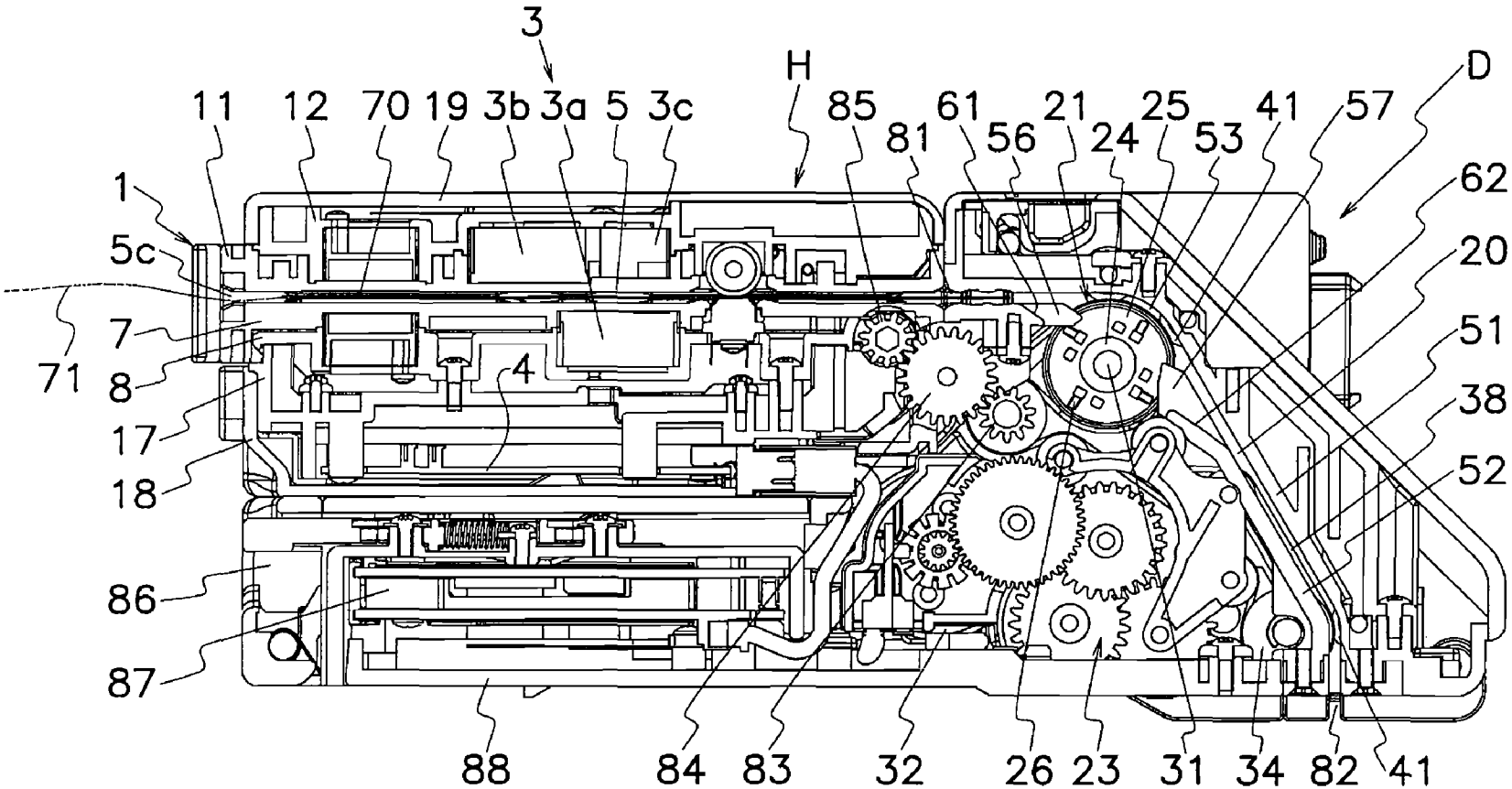
FIG. 3 is a sectional view of the bill validator wherein a bill is transported along a passageway formed therein toward the rotary anti-pullback unit.
Figure 4:
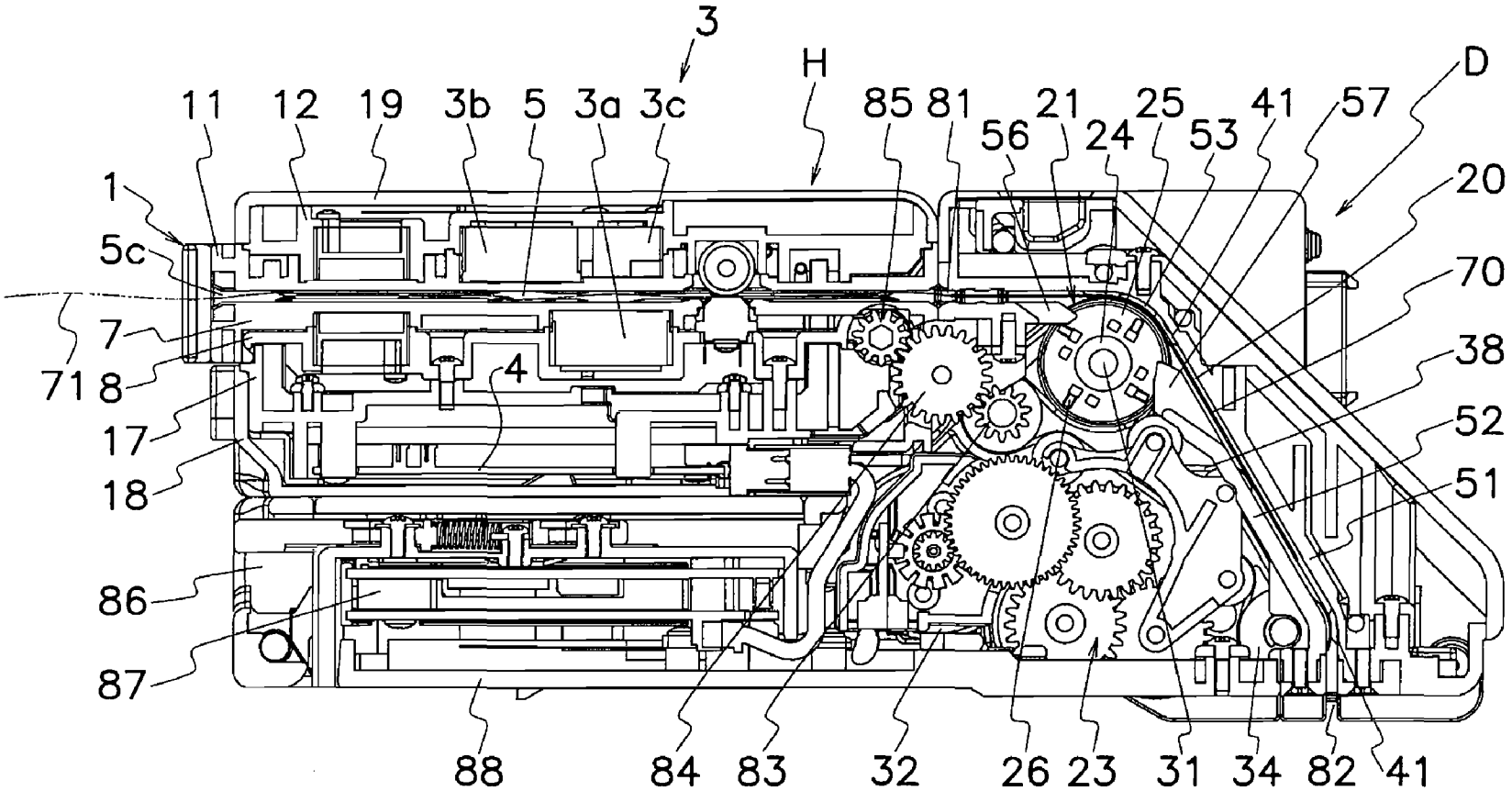
FIG. 4 is a sectional view of the bill validator showing the bill passing through the rotary anti-pullback unit.
Figure 5:
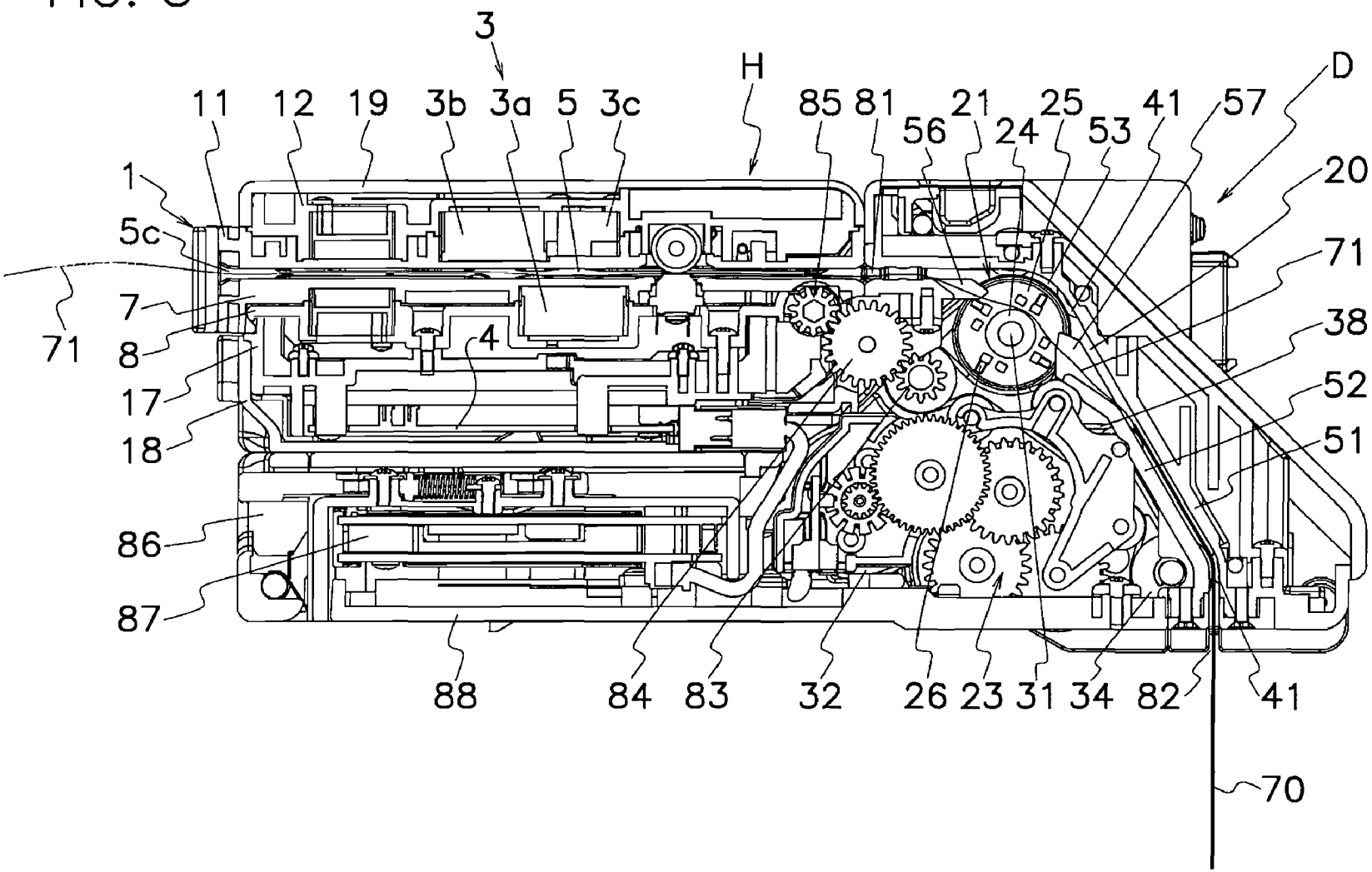
FIG. 5 is a sectional view showing a string connected to the bill that has passed the rotary anti-pullback unit.

As shown in FIGS. 1 to 5, lower optical sensor 3*a* and other electric/electronic elements are arranged between lower cover 7 and lower tray 8. Likewise, upper optical sensor and other electric/electronic elements are arranged between upper tray 11 and upper cover 12. As shown in FIGS. 3 to 5, attached to lower tray 8 is a drive gear 85 meshed with connection gear 84 to drive conveyer belts 2*a* in conveyer D shown in FIGS. 8 and 9. Conveyer belts 2*a* are disposed in horizontal path 20 through four openings 13 formed in lower cover 7 to grasp bill 70 between upper and lower conveyer belts 2*a* in a carrier device of discriminator H to deliver bill 70 along openings 13. Lower and upper optical sensors 3*a* and 3*b* of sensor device 3 each have a contact image sensor (CIS) which includes a plurality of light emitting elements and a plurality of photo-sensitive elements for receiving lights so that light emitting elements irradiate lights that penetrate lower cover 7 or upper tray 11, reflect on or penetrate bill 70, penetrate lower cover 7 or upper tray 11 and then are received by photo-sensitive elements.

In assembling the bill validator shown in FIGS. 1 and 2, discriminator H is attached to conveyer D by engaging latches (not shown) of discriminator H with guide rails 92, and then, discriminator H is moved into the back, sliding latches along guide rails 92 as shown in FIG. 6. When latches reach the completely inserted position, an outlet (not shown) of passageway 5 in discriminator H becomes communicated with inlet 81 of arcuate passage 53 of conveyer D, and simultaneously drive gear 85 of discriminator H comes into driving engagement with connection gear 24 of conveyer D to drive carrier device for transporting bill 70 in discriminator H by drive motor 32 in conveyer D.

After assemblage of the bill validator, when bill 70 is inserted into inlet 5*c* of discriminator H, optical inlet sensor detects insertion of bill 70 into inlet 5*c* to produce a detection signal to control device 87 which then starts to operate drive motor 32 in rotor driver 23 of conveyer D. Accordingly, carrier belts 2*a* in carrier device of discriminator H shown in FIGS. 9 and 10 are rotated, and concurrently, drive belts 38 and 39 in conveyer D run to rotate rotor pulleys 36, 37 along with rotor 22 in anti-pullback unit 21, and thereby bill 70 is moved in the back of passageway 5 along horizontal path 20. In this case, if string 71 is connected to a rear end of bill 70, it also is dragged into horizontal path 20 with forward movement of bill 70, while upper and lower optical sensors 3*b* and 3*a* and magnetic sensor 3*d* pick out physical features of bill 70 traveling along horizontal path 20 to produce detection signals to control device 87.

Subsequently, bill 70 is sent from horizontal path 20 in discriminator H through inlet 81 of conveyer D into arcuate passage 53 formed between disks 25 of rotor 22 and arcuate member 66 of upper guide member 51, it is then grasped between drive belts 38, 39 and pinch rollers 41, 42 and carried through arcuate passage 53 and inclined path 63 to outlet 82. At the moment, rotor 22 is rotated concurrently with bill 70 carried along outer periphery of disks 25 in contact to transported bill 70, and therefore, flexible string 71 connected to bill 70 is radially inwardly moved along inclined guide surface 26*a* of fin 26. In this case, string 71 extends throughout passageway 5 from horizontal path 20 through arcuate passage 53 to inclined path 63, and forward movement of drive belts 38, 39 provokes a tensile force pulling bill 70 and string 71.

Figure 23:
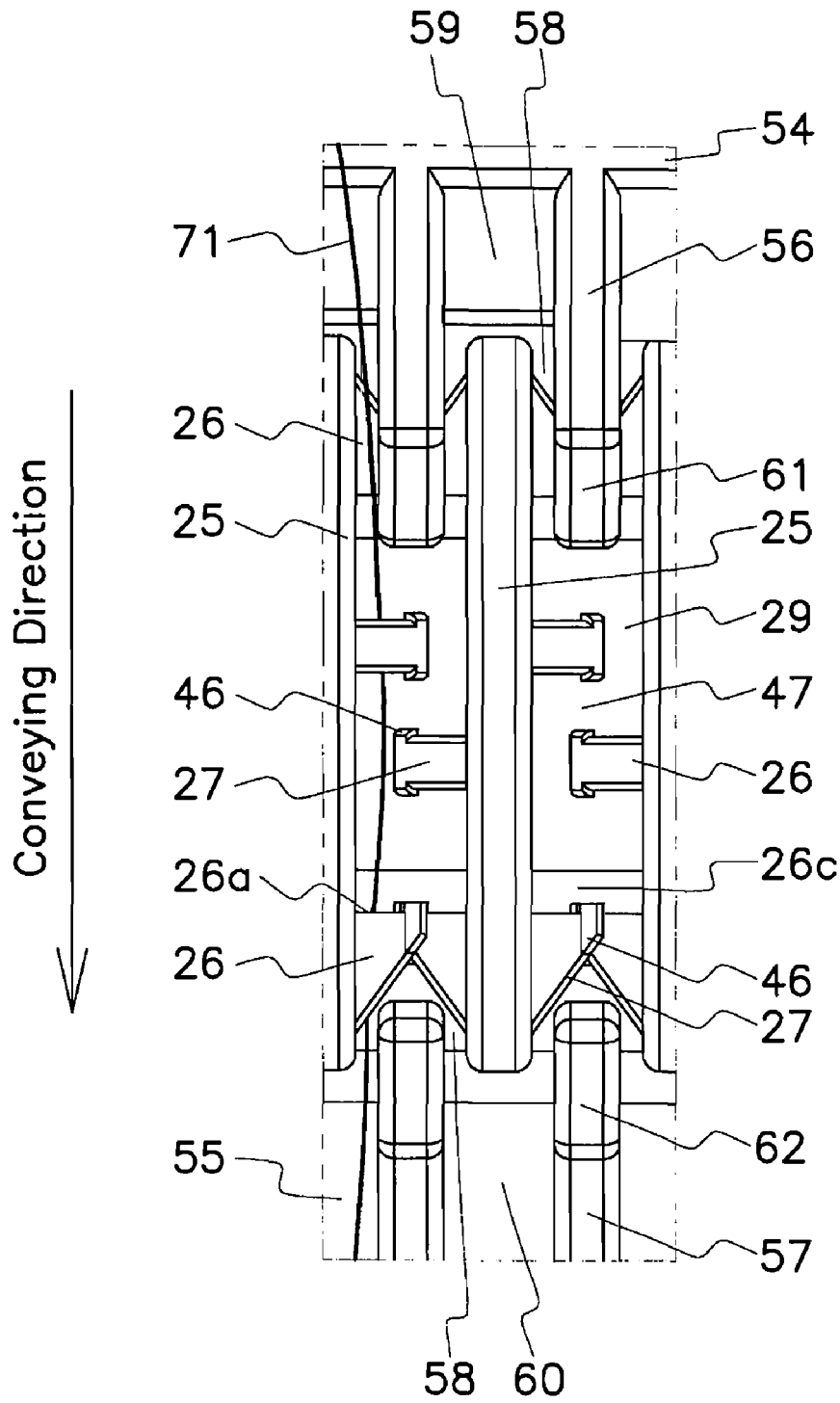
FIG. 23 is a partial side view showing a string wound around the rotor.
Figure 24:
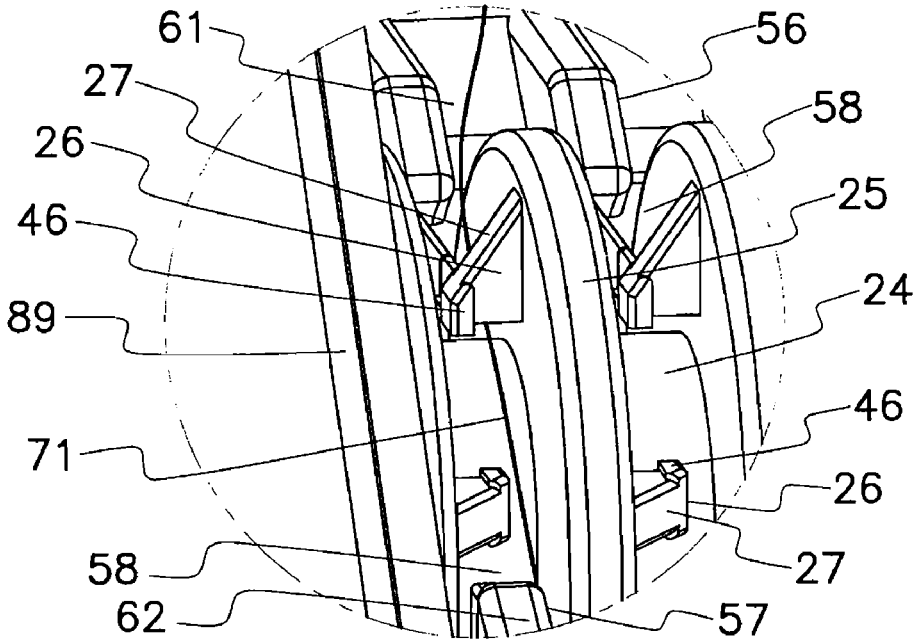
FIG. 24 is a partial perspective view of the rotor shown in FIG. 23.

Since tensile force will try to extend string 71 in arcuate passage 53 by airline or minimal distance, tensile force or tension possibly as well as the gravity, presses string 71 around guide surfaces 26*a* of fins 26 in arcuate passage 53 so that string 71 may forcibly be radially inwardly moved through oblique gap 58 formed between tongues 56, 57 and guide surfaces 26*a* and also through circumferential gap 47 formed between opposed fins 26 while string 71 is sliding on guide surfaces 26*a* of opposed fins 26 under the tension and its own gravity, and finally string 71 can be entrapped into capture space 26*c* between barb 26*b* and column 29 as shown in FIGS. 5, 23 and 24, and brought into engagement with barb 26*b* of fin 26. In other words, rotation of rotor 22 and guidance by tongue 56, 57 facilitate movement of string 71 connected to bill 70 through oblique gap 58 formed between tongue 56, 57 and fin 26 and also through circumferential gap 47 formed between fins 26 so that string 71 is brought into engagement with at least one of fins 26 or at least one barb 26*b* of fins 26. At that time, resultant tension presses flexible string 71 on guide surfaces 26*a* of fins 26, and causes it to radially inwardly slip along guide surfaces 26*a* and thereby go through oblique gap 58 formed between tongues 56, 57 and guide surfaces 26*a* and through a circumferential gap 47 formed between opposed fins 26 into capture space 26*c* between barb 26*b* and column 29. Therefore, flexible string 71 smoothly goes into capture space 26*c*, and rotation of rotor 22 causes flexible string 71 to tangle around column 29 and fin or fins 26.

In this case, once string 71 is entrapped in capture space 26*c*, as shown in FIGS. 1 and 2, rotation of rotor 21 causes string 71 to be, inextricably without access to rotor 21, wound up around rotor 21 through capture space 26*c* and tangled with barb or barbs 26*b* of fins 26, and this certainly prevents unduly pullback or extraction of bill 70 and obviously improves in security and reliability of bill validator. To this end, each flange 46*a* of hook 46 at each tip of fins 26 effectively prevents string 71 from escaping from capture space 26*c* between barb 26*b* and column 29. When regular staff moves upper guide member 51 of conveyer D to an opened position (not shown) to gain access to rotor 21, he can readily remove string 71 from exposed column 29.

The bill validator in this embodiment does the following operations:

(1) Drive belts 38, 39 and pinch rollers 41, 42 of rotor driver 23 serve to transport bill 70 past anti-pullback unit 21 along inclined path 63, dragging or pulling string 71 connected to bill 70 to produce tension in string 71.

(2) Resultant tension presses string 71 on guide surfaces 26*a* of circumferentially adjoining fins 26 by airline distance, and causes flexible string 71 to radially inwardly slip along guide surfaces 26*a*, thereby go through oblique gap 58 formed between tongues 56, 57 and guide surfaces 26*a* and through circumferential gap 47 formed between opposed fins 26, and finally enter capture space 26*c* between barb 26*b* and column 29 as shown in FIGS. 5, 23 and 24.

(3) When flexible string 71 goes into capture space 26*c*, rotation of rotor 22 causes flexible string 71 to tangle around column 29 and fin or fins 26 as shown in FIGS. 1 and 2.

(4) When the anti-pullback unit 21 is mounted in conveyer D, discriminator H can has a simple construction and shorter passageway 5 without anti-pullback unit 21.

(5) Each disk 25 may be formed into a shape in mirror image or in symmetric configuration about the central axis, and rotor 22 has no initial position, and therefore, although rotor 22 has rotated to transport bill 70 toward outlet 82, rotor 22 does not need to be returned to its initial position to transport a subsequent bill 70.

Embodiments of the present invention may be modified in various ways without limitation to the foregoing embodiments. For example, the anti-pullback unit 21 may be mounted in discriminator H in place of or in addition to that in conveyer D. In the above-mentioned embodiments, rotor 22 may be drivingly connected to a rotor driver 23 to aggressively rotate rotor 22 independently of contact to transported bill 70. Thus, the arrangement can inextricably wind up string 71 around rotor 22 and firmly engage string 71 with barb 26*b* of fin 26 to prevent unduly pullback or extraction of bill 70. However, the invention contemplates another construction of rotor 22 simply rotatably supported by frame 43 without rotor driver 23 so that rotor 22 can be automatically rotated by a frictional force applied to disks 25 by transporting bill 70 in contact to each outer periphery of disks 25.

Figure 25:
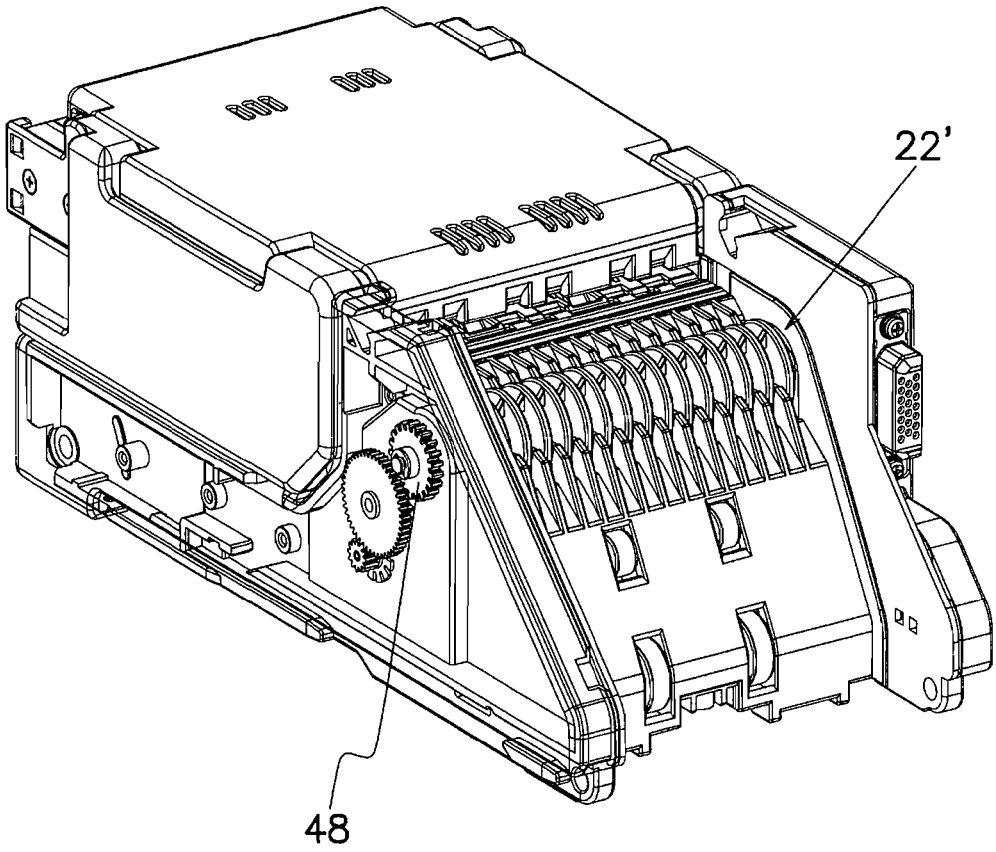
FIG. 25 is a perspective view showing another embodiment of a rotor driver.
Figure 26:
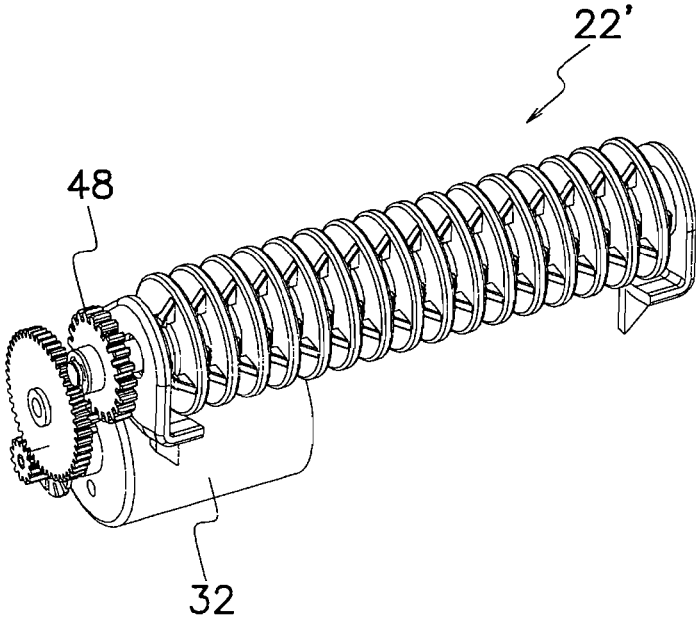
FIG. 26 is a perspective view of a rotor built in the rotor driver shown in FIG. 25.
Figure 27:
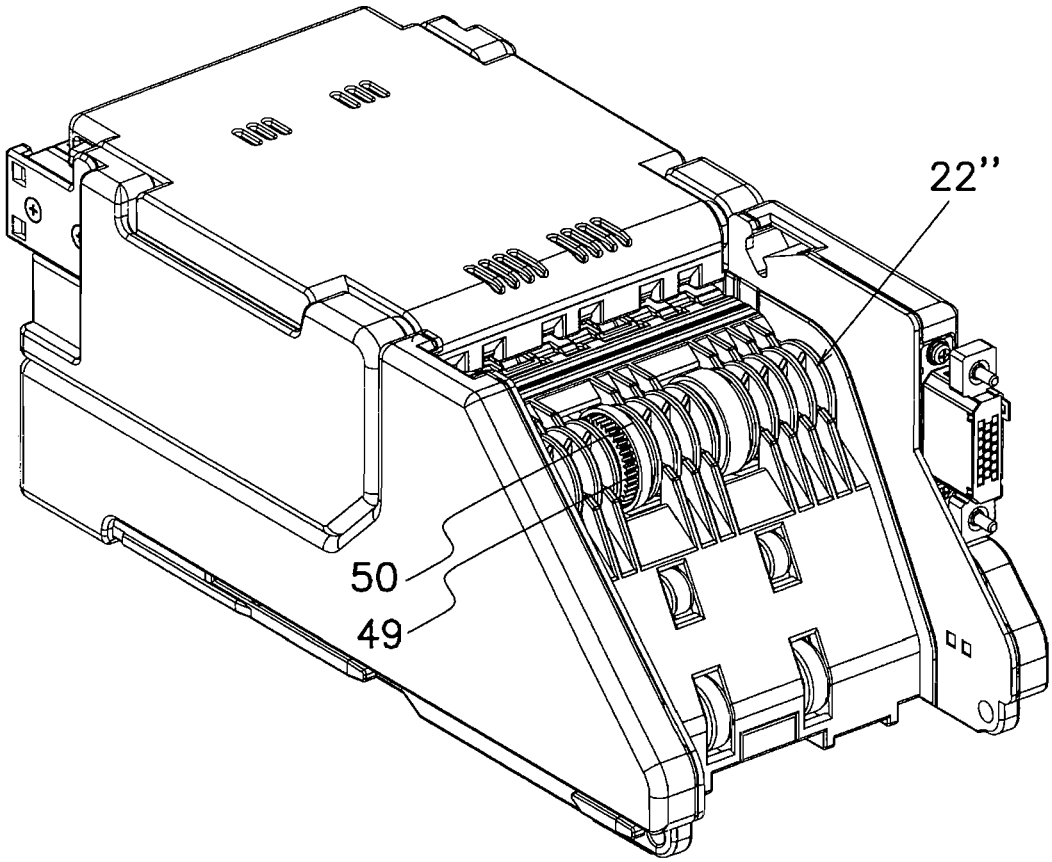
FIG. 27 is a perspective view showing still another embodiment of the rotor driver.
Figure 28:
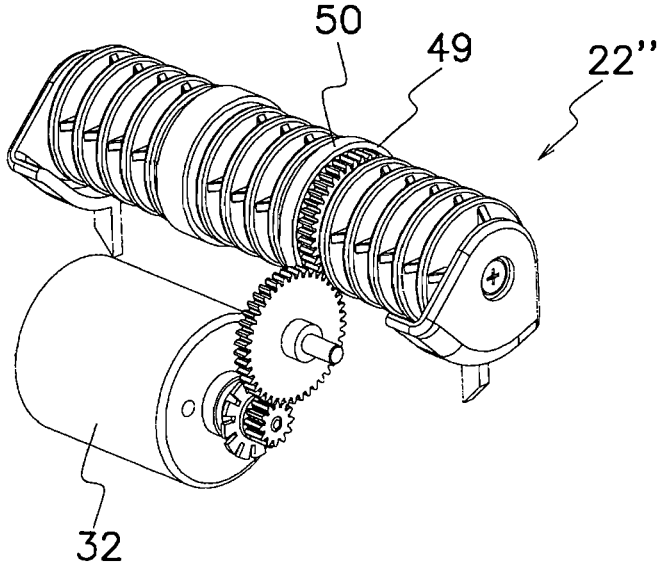
FIG. 28 is a perspective view of a rotor built in the rotor driver shown in FIG. 27.

Accordingly, a specific embodiment of the present invention does not necessarily require rotor driver 23 and rotor pulleys 36 and 37. Rotor pulleys 36, 37 may be mounted not between rollers 41, 42 but at one end or at opposite ends of rotor 22. As shown in FIGS. 25 and 26, a passive gear 48 may be attached to rotor 22 to rotate it by drive motor 32 via pinion 93 and power transmission gears 94 to 100 without rotor pulleys 36, 37. Alternatively, as shown in FIGS. 27 and 28, another passive gear 49 may be attached to rotor 22 or roller 50 for their integral rotation. In lieu of regularly angular intervals of 90 degrees, fins 26 may be formed on disk 25 at regularly or irregularly different angular intervals.

Figure 29:
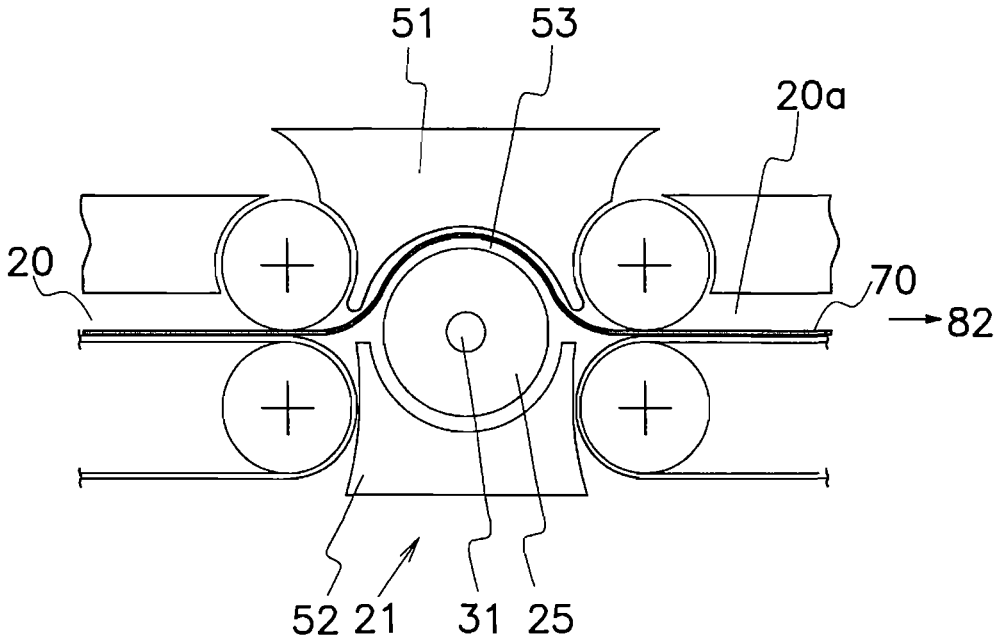
FIG. 29 is a sectional view of a further embodiment showing an arcuate passage curved in an angular range of approximately 180 degrees.

FIG. 29 shows a further embodiment of an arcuate passage 53 curved over an angular range θ of approximately 180 degrees around support shaft 31 on the way of horizontal path 20. Bill 70 that has passed arcuate passage 53 and rotor 22, is further carried through horizontal exit path 20*a* communicated with outlet 82 by pulling force of rotor driver 23 while dragging or pulling string 71 connected to bill 70 and producing tensile force or tension in string 71. In this embodiment, arcuate passage 53 is formed in a circular gap defined between outer periphery of disks 25 and upper and lower guide members 51, 52 disposed in radially spaced relation to disks 25. Horizontal exit path 20*a* may be connected to outlet 82 in the horizontal condition or connected to outlet 82 through an inclined or curved path.

While the foregoing embodiments refer to handling of bill or document as a valuable document, however, it would be apparent that the arrangement according to the present invention can be applied to handling of valuable documents such as currencies, bank notes, tenders, coupons, scrip other than bill.

INDUSTRIAL APPLICABILITY

The present invention may be applied to document handlers that need to prevent or block unauthorized extraction of a document received in the document handler by drawing an extracting tool connected to the document.

What is claimed are:

1. A rotary anti-pullback unit of fletched fins comprising: a rotor and a frame for rotatably supporting the rotor, wherein the rotor comprises a plurality of disks arranged coaxially in a line and in axially spaced relation to each other, and a plurality of fletched fins axially protruding from radial surfaces of the disks toward an opposite radial surface of the other adjoining spaced disk, each of the fins comprises a radially outwardly tapered guide surface formed at the radially outer edge of the fin, a barb formed at the radially inner edge of the fin and a hook formed in each tip of the fins between the guide surface and barb for each fin to axially protrude toward to an opposed radial surface of the spaced adjoining disk so that the hook is closer to the opposed radial surface of the adjoining disk than that fin axially protruding from the opposed radial surface of the spaced adjoining disk.

2. The rotary anti-pullback unit of claim 1, wherein each of the disks has its opposite radial surfaces formed with the fins axially protruding there from.

3. The rotary anti-pullback unit of claim 1, wherein the rotor has a column formed at the center of the rotor, the column are rotatably supported by the frame at the opposite ends, a plurality of the disks are secured in axially spaced relation from each other on the column to radially outwardly extend from the column.

4. The rotary anti-pullback unit of claim 1, wherein the rotor is rotated concurrently with a document transported along each outer periphery of the disks in contact to the transported document to radially inwardly move an extracting tool connected to the document along the tapered guide surface of the fin, and bring the extracting tool into engagement with the barb of the fin.

5. The rotary anti-pullback unit of claim 4, further comprising a rotor driver for rotating the rotor when the document is transported along each outer periphery of the disks.

6. The rotary anti-pullback unit of claim 3, wherein the frame comprises a bracket for rotatably bearing the rotor, the bracket has a pair of support bosses located opposite both axial ends of the rotor.

7. The rotary anti-pullback unit of claim 5, wherein the rotor driver comprises a drive motor, and at least one rotor pulley or gear coaxially mounted on the rotor for integral rotation therewith by operation of the drive motor when the document is transported along each outer periphery of the disks in contact to the transported document.

8. The rotary anti-pullback unit of claim 1, wherein each of the disks has its configuration formed in a mirror image with respect to the central axis of the disks.

9. The rotary anti-pullback unit of claim 6, wherein the rotor comprises a support shaft whose both ends are received in corresponding recesses formed in the bracket.

10. The rotary anti-pullback unit of claim 9, wherein the rotor comprises at least one roller formed with a plurality of the disks, the support shaft is received in a perforation formed in the roller.

11. The rotary anti-pullback unit of claim 5, wherein the rotor driver comprises a drive motor, a gear train driven by the drive motor, at least one drive pulley driven by the gear train, at least one rotor pulley coaxially mounted on the rotor and a drive belt mutually wound around the drive pulley and the rotor pulley.

12. The rotary anti-pullback unit of claim 11, further comprising at least one pinch roller for urging the document on the drive belt for sandwiching the document between the drive belt and pinch roller for transportation of the document.

13. The rotary anti-pullback unit of claim 1, wherein the hook protrudes in the circumferential and radially inward directions of the fin.

14. The rotary anti-pullback unit of claim 1, wherein each radial surface of the disks has two or more fins formed on the radial surface at regularly or irregularly angular intervals.

15. The rotary anti-pullback unit of claim 1, wherein one radial surface of one disk has the fins axially protruding toward an opposed radial surface of the other spaced adjoining disk whose opposed radial surface has the fins axially and in the opposite direction protruding toward the one radial surface of the one disk, and the closest two fins in the one and the other radial surfaces are grouped into a pair with a circumferential gap between the paired fins.

16. The rotary anti-pullback unit of claim 1, wherein each of the fins is formed at a location away from a diametric plane passing through a rotation axis of the disk by a certain distance, and each guide surface of the fins spreads into a feathering or triangular shape in parallel to the diametric plane.

17. The rotary anti-pullback unit of claim 15, wherein a pair of the closest fins extend from the one and the other radial surfaces in the opposite direction.

18. The rotary anti-pullback unit of claim 4 mounted in a conveyor of a document validator which comprises upper and lower guide members for providing upper and lower walls of a passageway to guide the transported document.

19. The rotary anti-pullback unit of claim 18, wherein the upper guide member comprises upper plate and inclined members, the upper inclined member slanting with respect to the upper plate member by a given angle, the lower guide member comprises lower plate and inclined members, the lower inclined member slanting with respect to the lower plate member by a given angle, the lower plate and inclined members are placed with a longitudinal gap for receiving the rotor to form the arcuate passage between the rotor and an arcuate member of the upper guide member, the arcuate passage is curved around a support shaft of the rotor in an angular range between 60 and 180 degrees.

20. The rotary anti-pullback unit of claim 19, wherein the upper and lower plate members make up together a transport path extending from an inlet of the conveyer to the arcuate passage, the upper and lower inclined members make up together an inclined path extending from the arcuate passage to an outlet of the conveyer.

21. The rotary anti-pullback unit of claim 20, wherein each of the lower plate and inclined members of the lower guide member is formed with tongues jutting there from toward the rotor.

22. The rotary anti-pullback unit of claim 21, wherein each of the tongues extends toward the inclined guide surfaces of the fin and terminates before the inclined guide surfaces with an oblique gap between the tongue and the inclined guide surface.

23. The rotary anti-pullback unit of claim 21, wherein each of the lower plate and inclined members has a cutoff surface flush with a plane passing through the central axis of a support shaft of the rotor.

24. The rotary anti-pullback unit of claim 20, further comprising a rotor driver for rotating the rotor when the document is transported along each outer periphery of the disks, wherein the document that has passed the anti-pullback unit is further transported in the forward direction along the inclined path by pulling force of the rotor driver to produce a tension in the extracting tool connected to the document.

25. The rotary anti-pullback unit of claim 24, wherein the resultant tension presses the extracting tool on the guide surfaces of the fins, and causes the flexible extracting tool to radially inwardly slip along the guide surfaces and thereby go through an oblique gap formed between the tongue and guide surface and through a circumferential gap formed between the opposed fins into a capture space between the barb and column.

26. The rotary anti-pullback unit of claim 25, wherein rotation of the rotor causes flexible extracting tool to tangle around the column and fin or fins after the flexible extracting tool goes into the capture space.

27. The rotary anti-pullback unit of claim 1, wherein the opposed fins extend in the adverse direction from the corresponding radial surfaces of the spaced adjoining disks with a circumferential gap, and the opposed fins have an axial overlap by at least one portion of the fins.

* * * * *